US011147403B1

(12) United States Patent
Shendelman

(10) Patent No.: US 11,147,403 B1
(45) Date of Patent: Oct. 19, 2021

(54) PORTABLE FOOD HANDLING DEVICES

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 0 days.

(21) Appl. No.: 17/145,640

(22) Filed: Jan. 11, 2021

(51) Int. Cl.
*A47G 21/00* (2006.01)

(52) U.S. Cl.
CPC ..... *A47G 21/001* (2013.01)

(58) Field of Classification Search
CPC ..... A47G 21/001
See application file for complete search history.

(56) References Cited

U.S. PATENT DOCUMENTS

| | | | | |
|---|---|---|---|---|
| 688,753 | A | 12/1901 | Storrs | |
| 1,221,217 | A | 4/1917 | Quinliven et al. | |
| 1,734,045 | A | 11/1929 | Parran | |
| 2,000,301 | A | 5/1935 | Norman et al. | |
| 2,013,901 | A | 9/1935 | Shankland | |
| 2,232,031 | A | 2/1941 | Peter et al. | |
| 2,347,823 | A | 5/1944 | Leon et al. | |
| 2,591,855 | A | 4/1952 | Nicholson | |
| 3,094,264 | A | 6/1963 | John et al. | |
| 3,193,139 | A | 7/1965 | Iannone et al. | |
| 3,499,538 | A | 3/1970 | Sherard et al. | |
| 4,907,707 | A | 3/1990 | Crum | |
| 5,042,666 | A | 8/1991 | Dolenc | |
| 5,178,298 | A | 1/1993 | Allina | |
| 5,493,976 | A | 2/1996 | Hammond | |
| 6,543,639 | B1 | 4/2003 | Kovens | |
| 9,345,352 | B2 | 5/2016 | Shendelman | |
| 9,901,202 | B2 | 2/2018 | Shendelman | |
| 10,182,675 | B2 | 1/2019 | Shendelman | |
| 10,575,669 | B2 * | 3/2020 | Miller | A47G 19/02 |
| 10,849,446 | B2 | 12/2020 | Shendelman | |
| 2005/0082287 | A1 * | 4/2005 | Shendelman | A47G 19/065 220/23.8 |
| 2013/0284619 | A1 * | 10/2013 | Daley | B65D 81/3813 206/216 |
| 2014/0242230 | A1 | 8/2014 | Iwegbu | |
| 2014/0261095 | A1 * | 9/2014 | Shendelman | A47G 21/001 108/28 |
| 2014/0314902 | A1 | 10/2014 | Maynard | |
| 2015/0060532 | A1 * | 3/2015 | Goldstein | A47G 21/001 229/87.08 |
| 2015/0265080 | A1 | 9/2015 | Bagi et al. | |
| 2016/0120342 | A1 | 5/2016 | Petersburg | |
| 2018/0008071 | A1 * | 1/2018 | Jeong | A47G 21/001 |
| 2018/0184823 | A1 | 7/2018 | Miller et al. | |
| 2018/0296012 | A1 | 10/2018 | Woods | |

* cited by examiner

*Primary Examiner* — Stephen A Vu
(74) *Attorney, Agent, or Firm* — Patterson Thuente Pedersen, P.A.

(57) ABSTRACT

A portable food handling device including a flexible strip having a body portion and a first and second end region, the body portion bent into a closed loop configuration to define an interior space configured to receive foodstuffs therein. Such a portable food handling device can include a feeder that can rotate to linearly advance the foodstuff in a bite-by-bite manner into the user's mouth. The foodstuff is thus incrementally exposed so that it can be directly eaten in a sanitary manner without using eating accessories, such as plates and/or utensils, as well as without one's hands directly touching and contaminating the foodstuff to prevent the spread of disease and pandemics.

25 Claims, 21 Drawing Sheets

PORTABLE FOOD HANDLING DEVICES

TECHNICAL FIELD

The present disclosure relates generally to portable food handling devices, and more particularly to a portable food handling device configured to enable a foodstuff to be incrementally exposed so that it can be directly eaten in a sanitary, bite-by-bite manner without directly touching and contaminating the foodstuff Such a portable food handling device can inhibit the spread of disease and pandemics.

BACKGROUND

Foodstuffs (e.g., slices of pizza, hot dogs, sushi, doughnuts, bagels, salads, cakes, etc.), can be difficult, awkward, and messy to handle. Holding such foodstuffs while eating in a sanitary, tidy manner and without soiling one's hands, spilling drippings, pieces, or toppings, can be a challenge, particularly when not seated at a table (e.g., when eating on the go). To avoid touching the foodstuffs directly, in many cases one must rely on traditional eating accessories and/or utensils (e.g., a fork, spoon, knife, chopsticks, etc.) in order to transfer the foodstuff into one's mouth. When a plate or bowl containing the food cannot be positioned on a stable surface, the process of consuming the foodstuff generally requires two hands: one hand to hold the plate or bowl, and a second hand to transfer the foodstuff into one's mouth. In such cases, the simultaneous carrying of a drink to accompany the foodstuff is challenging.

Various advances in portable food handling devices have been developed over the years. Examples of such devices are disclosed in U.S. Pat. Nos. 9,345,352; 9,901,202; 10,182,675; 10,849,446 (assigned to the Applicant of the present disclosure), the contents of which are hereby incorporated by reference herein. Although such portable food handling devices work well for their intended purpose, further improvements are desirable. The present disclosure addresses this concern.

SUMMARY OF THE DISCLOSURE

Embodiments of the present disclosure provide portable food handling devices and methods for delivering solid and/or non-solid foodstuffs in a comfortable and sanitary manner directly to a user's mouth without using eating accessories (e.g., a fork, spoon, knife, chopsticks, etc.). Embodiments of the present disclosure can be beneficial in both indoor and outdoor activities, sports arenas, cafeterias, hospitals, rehabilitation facilities, schools, universities, cars, boats, planes, as well as in disaster relief kits, and the like. Moreover, embodiments of the present disclosure are advantageously sized to fit inside lunch boxes. In their broadest aspect, embodiments of the present disclosure can handle and dispense non-food items.

One embodiment of the present disclosure provides a portable food handling device, including a flexible strip having a body portion and a first and second end region, the body portion bent into a closed loop configuration to define an interior space configured to receive foodstuffs therein, the first and second end regions bound together and extending at least partially diametrically across the interior space defined by the body portion to contact the foodstuffs received within the interior space, wherein the flexible strip includes one or more perforations configured to enable ease in removal of portions of at least one of the first and second end region for resizing of the flexible strip to create a closed loop configuration defining an interior space over a range of different sizes.

In one embodiment, the flexible strip defines a plurality of apertures configured to receive one or more fasteners. In one embodiment, the flexible strip defines a plurality of projections and corresponding recesses integrally formed within the flexible strip, wherein a projection defined on a first end region is receivable within a recess defined on a second end region, thereby coupling the first end region to the second end region. In one embodiment, at least one of the one or more perforations are positioned between at least one of the plurality of projections or recesses integrally formed within the flexible strip. In one embodiment, the body portion includes a forward facing projection and rear facing projection configured to support foodstuffs received within the interior space.

Another embodiment of the present disclosure provides a portable food handling assembly, including a portable food handling device including a flexible strip having a body portion and a first and second end region, the body portion bent into a closed loop configuration to define an interior space configured to receive foodstuffs therein, the first and second end regions bound together and extending at least partially diametrically across the interior space defined by the body portion to contact the foodstuffs received within the interior space, and a detachable bracket-holder configured to selectively clip onto the body portion of the portable food handling device.

In one embodiment, the bracket-holder includes circular sidewall including an internal surface defining a space for receiving a beverage container. In one embodiment, the bracket-holder includes a circular sidewall including an internal surface defining one or more slots configured to receive at least one of eating utensils, foodstuffs or electronic devices. In one embodiment, the bracket-holder includes a plurality of fingers configured to be positioned on opposing sides of the body portion of the flexible strip. In one embodiment, at least one of the plurality of fingers includes a projection configured to inhibit the bracket-holder from slipping off of the body portion of the flexible strip. In one embodiment, the bracket-holder includes a handle. In one embodiment, the handle is foldable between a carrying position and a stowed position.

Another embodiment of the present disclosure provides a portable food handling device, including a flexible strip having a body portion and a first and second end region, the body portion bent into a closed loop configuration to define an interior space configured to receive foodstuffs therein, the first and second end regions bound together and extending at least partially diametrically across the interior space defined by the body portion, and a feeder mechanism configured to linearly advance the foodstuffs received within the interior space through the flexible strip in a bite-by-bite manner.

In one embodiment, the feeder mechanism is pivotally coupled to the first and second end regions of the flexible strip. In one embodiment, the feeder mechanism includes a scoop configured to contact the foodstuffs received within the interior space defined by the body portion of the flexible strip. In one embodiment, wherein the feeder mechanism includes an adjustable stopper configured to enable adjustment of the linear advancement of the foodstuffs through the flexible strip. In one embodiment, the feeder mechanism includes one or more characters configured to move during operation of the feeder mechanism.

In one embodiment, the feeder mechanism includes a camera configured to detect movement of the feeder mechanism relative to the flexible strip. In one embodiment, data from the camera is wirelessly communicated to a computing device for processing. In such an embodiment, data from the camera is stored on the computing device. In one embodiment, data from the camera is wirelessly communicated to other users.

Another embodiment of the present disclosure provides a food service assembly for holding a food handling device for eating a foodstuff and accessories to hold electronic and non-electronic devices, including an upper portion bounding a compartment in which is the food handling device is held, an upper portion bounding at least one compartment in which accessories are held, and top portions extend vertically and angularly elongated to create opposite fingers which are when in use bounded together.

In one embodiment, the top portion of one of the fingers has teeth spaced horizontally apart. In one embodiment, the top portion of the other finger has a slot to receive an opposite finger. In one embodiment, the upper portion of slot has a pit. In one embodiment, the left and right fingers are made from a resilient material. In one embodiment, opposite fingers are bounded together by resilient interaction and interlocked by he one of the fingers teeth are pressed against the other opposite finger pit.

Another embodiment of the present disclosure provides a portable food handling assembly for use in eating a foodstuff, including a holder for holding the foodstuff, and a movable member movable relative to the holder, for incrementally exposing and feeding integral successive variable portions of the foodstuff directly into the mouth of a user to enable the foodstuff to be eaten bite-by-bite in a hands free, sanitary manner without using eating utensils, wherein the holder has a holding portion that engages and holds the foodstuff against movement during movement of the movable member, wherein the holder has an annual portion bounding an interior and supporting the movable member and the foodstuff within the interior of the annual body portion, and wherein the holding portion extends within the interior of the annual body portion at least partly across the annual body portion into engagement with the foodstuff, and wherein the holding portion is an elongated, adjustable strip having opposite end regions and pairs of fasteners, and wherein the opposite end regions of the strip are brought together to form the annular body portion, and bracket-holder for holding cups, liquid containers and accessories mounted to the upper portion of a portable food handling device.

In one embodiment, the bracket-holder is comprised of upper and bottom portions and made from a resilient material. In one embodiment, a bottom portion of bracket-holder has a vertical neck portion and two or more spaced apart fingers, and upper portion having opposite centrally located finger wherein, end portion having projections and creating an area to secure fit into the upper portion of the strip. In one embodiment, a bottom portion of bracket-holder spaced apart fingers inserted between fasteners below the strip, and upper opposite finger placed above the strip to have a secure attachment, and prevent fasteners and subsequently portable food handling device from disengagement and collapse. In one embodiment, the upper end portion of bracket-holder has a centrally located area for receiving beverages, and a slot for receiving electronic devices, and a handle placed on the outer periphery of the upper portion for portability of the bracket-holder and food handling device, and bottom portion has a bowl to collect spillage from a liquid holding container. In one embodiment, the feeder device is mounted between the strip portions at the lower end region for an axial movement and comprising from an axle's larger diameter and smaller diameter at the ends, and a larger diameter serving as a spacer between an end portion of the strip, and smaller diameters inserted in the bore located at the bottom portion of the strip, and wherein a downwardly projected pointer located at the outer central bottom portion of an axle, and horizontally attached to it a sweeper located at the end portion of the pointer.

In one embodiment, a "T"-shaped bottom portion is vertically attached to the upper central portion of an axle and its horizontal portion having two opposite ends located between strip in the annual portion, and horizontally positioned, and from one end it has a handle portion, and from another end a stopper portion, and pushing down a handle creates axial motion with a segmental rotation varied by adjustable stopper that moves the distance until the end of a stopper surface in a contact with the outer vertical side portion surface of a strip, and wherein the rotating motion moves pointer to move the foodstuff in a bite-by-bite in a sanitary manner without contamination, and hands touching food directly to the user's mouth. In one embodiment, the upper central portion of an axle has pair of vertically and externally spreader apart from a central portion of a strip portion left and right wings, and horizontally positioned end portions: a left a handle portion and a right a stopper portion, and pushing down a handle portion creates axial motion with a segmental rotation varied by adjustable stopper that moves the distance until the end of a stopper's surface in a contact with the outer vertical side portion of a strip surface, and wherein the rotating motion moves pointer to move the foodstuff in a bite-by-bite in a sanitary manner without contamination, and hands touching food directly to the user's mouth.

Another embodiment of the present disclosure provides a food handling device for use in eating a foodstuff, including a holder for holding the foodstuff, the holder having an opening that is constantly open and a movable member movable relative to the holder solely by manual action, for incrementally exposing and feeding integral successive variable portions of the foodstuff through the constantly open opening to a variable extend directly into user's mouth to enable the foodstuff to be bitten bite-by-bite in a sanitary manner without using eating utensils and without using the user's hands. In one embodiment, the holder and the movable member are constituted of biodegradable, microwaveable, disposable, and reusable materials for handling the cold or hot, soft or solid, foodstuff.

The summary above is not intended to describe each illustrated embodiment or every implementation of the present disclosure. The figures and the detailed description that follow more particularly exemplify these embodiments.

BRIEF DESCRIPTION OF THE DRAWINGS

The disclosure can be more completely understood in consideration of the following detailed description of various embodiments of the disclosure, in connection with the accompanying drawings, in which.

Figure 1:
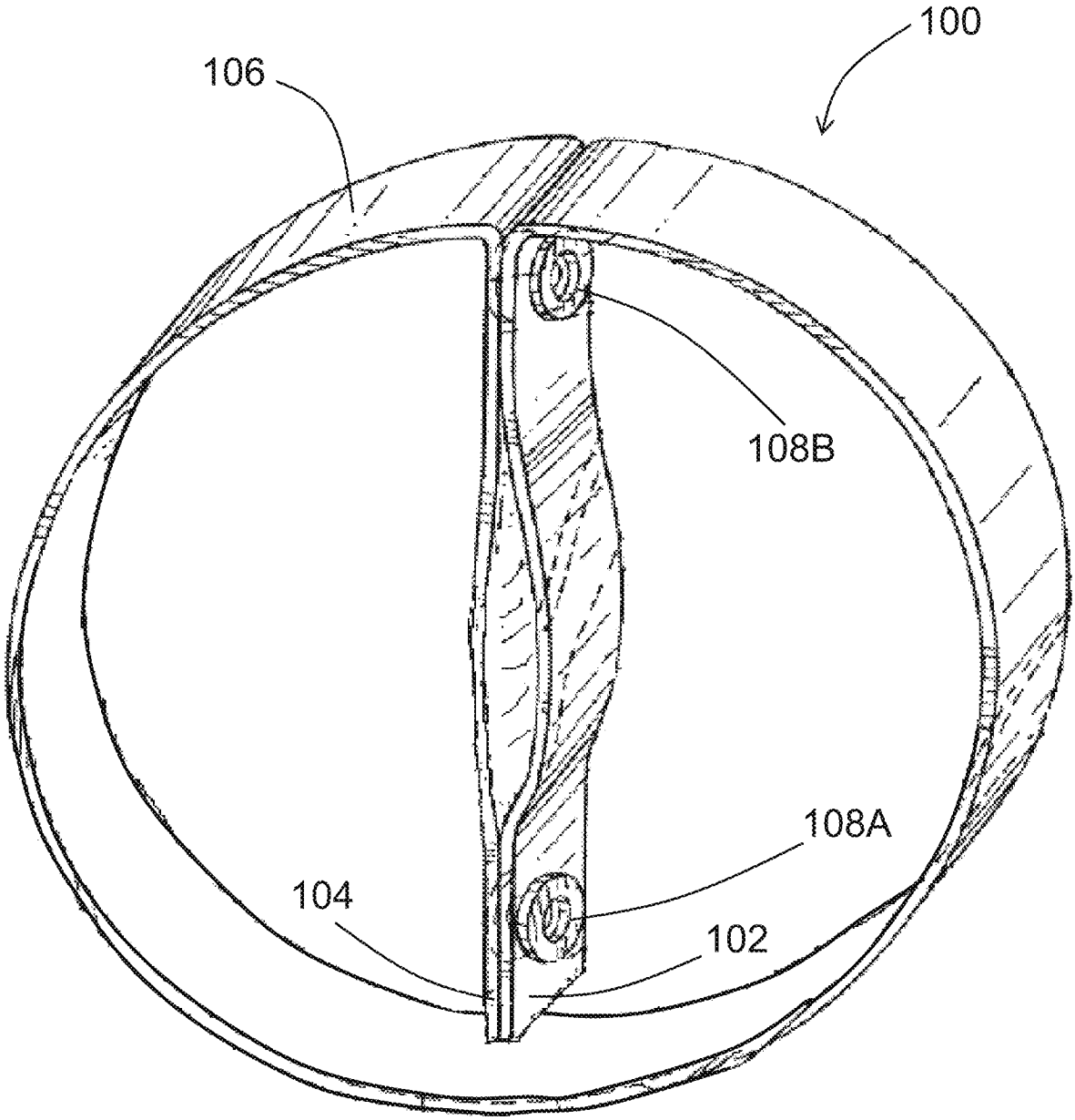
FIG. 1 is a perspective view depicting a portable food handling device, in accordance with an embodiment of the disclosure.

While embodiments of the disclosure are amenable to various modifications and alternative forms, specifics thereof shown by way of example in the drawings will be described in detail. It should be understood, however, that the intention is not to limit the disclosure to the particular embodiments described. On the contrary, the intention is to cover all modifications, equivalents, and alternatives falling within the spirit and scope of the subject matter as defined by the claims.

DETAILED DESCRIPTION

Referring to FIG. 1, a portable food handling device 100 is depicted in accordance with an embodiment of the disclosure. In some embodiments, the portable food handling device 100 can be constructed of a unitary, elongated adjustable strip having opposite end regions 102, 104, which can be brought together to form an annular body portion 106 bounding an interior. The portable food handling device 100 can be constructed of a resilient material, such as plastic; although the use of other materials is also contemplated. The portable food handling device 100 can include one or more fasteners 108A/B configured to secure opposite end regions 102, 104 together in a parallel arrangement on the interior of the annular body portion 106. In some embodiments, the one or more fasteners 108A/B can be a snap type fastener; although the use of other types of fasteners is also contemplated. Additionally, although FIG. 1 depicts the use of two fasteners 108A/B, the use of a greater or lesser number of fasteners is also contemplated. In some embodiments, adhesives, magnets, or hook-and-loop fasteners can be used to secure opposite end regions 102, 104 together.

Figure 2A:
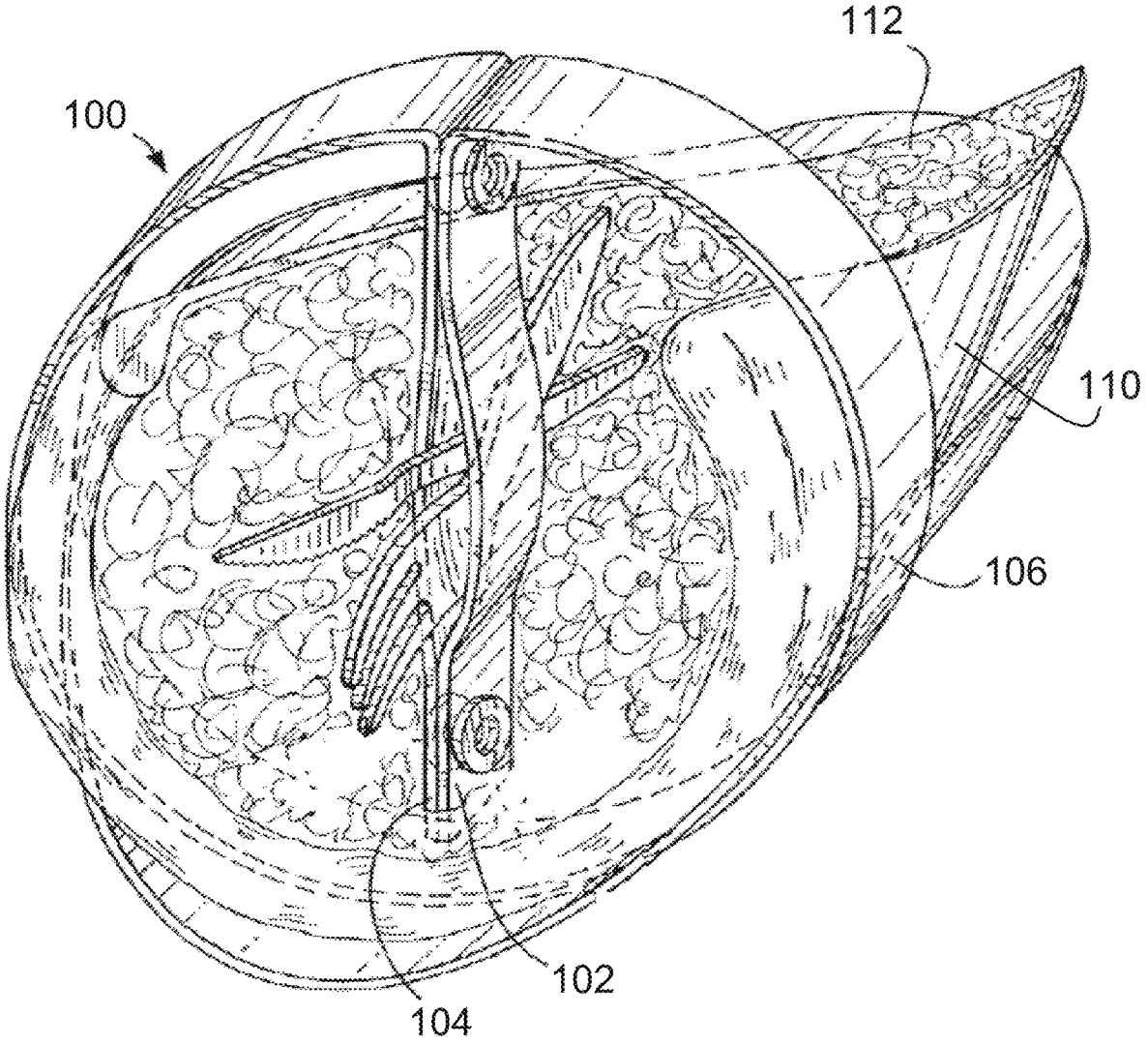
FIG. 2A is a perspective view depicting a portable food handling device with a foodstuff received therein, in accordance with an embodiment of the disclosure.
Figure 2B:
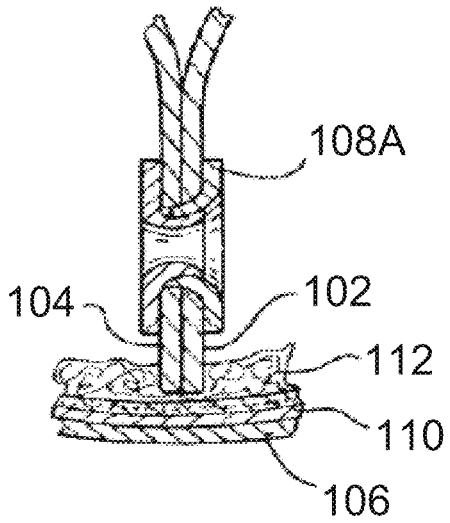
FIG. 2B is a close-up, partial, cross-sectional view depicting the portable food handling device of FIG. 2A.
Figure 2C:
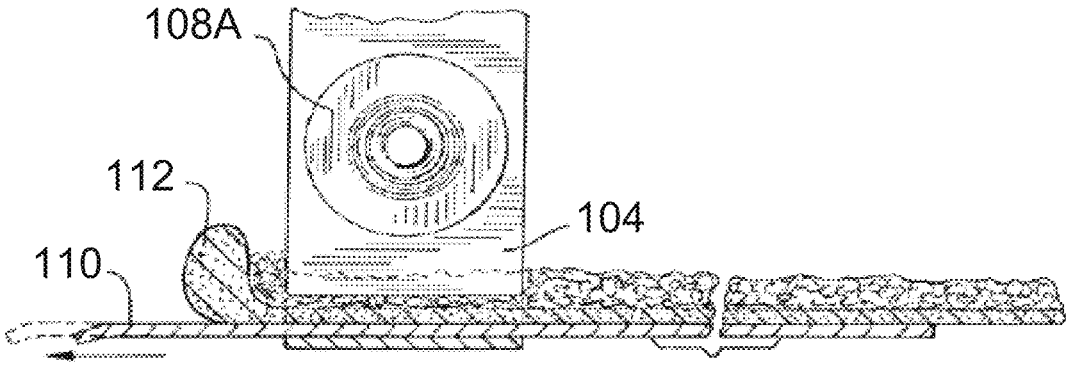
FIG. 2C is a close-up, partial profile view depicting the portable food handling device of FIG. 2A.

With additional reference to FIGS. 2A-C, in operation, a paper plate, carton or other semi-flexible foodstuff supporting surface 110 can be positioned within the interior of the annular body portion 106 of the portable food handling device 100. As depicted, the end regions 102, 104 can extend at least partially diametrically across the annular body portion 106, and into engagement with the foodstuff 112. In some embodiments, one or more eating accessories or utensils (e.g., fork, spoon, knife, chopsticks, napkin, straw, etc.) can be mounted or otherwise held within the annular center portion 106. The strips of annular body 106 that are secured together can have a longer length than the diameter of the annular body 106, creating sufficient resilience to hold eating accessories in place. Alternatively, one or more eating accessories can be mounted in a "V"-shaped recess located at a top of the annular body portion 106 (not shown).

With the foodstuff 112 positioned on the foodstuff supporting surface 110, the foodstuff supporting surface 110 can be bent into a curved shaped conformed to the inner circumferential surface of the annual body portion 106, and jointly placed underneath the opposite end regions 102, 104.

To facilitate ease in inserting the foodstuff 112 and supporting surface 110 into the portable food handling device, the opposing sides of the annular body portion 106 can be compressed together (e.g., gently squeezed), thereby creating a greater clearance between the end regions 102, 104 and the interior of the annular body portion 106. Upon release of the compression, the annual body portion 106 will naturally resume its circular shape, causing the end regions 102, 104 to come into engaging contact with the foodstuff 112, thereby holding the foodstuff stationary with respect to the portable food handling device 100.

Thereafter, a user can hold the portable food handling device 100 with one hand, and progressively pull a rear portion of the foodstuff supporting surface 110 with the other hand along a longitudinal direction perpendicular to the annular body portion 106, thereby enabling the user to incrementally expose the foodstuff 112 in order to eat the foodstuff 112 bite-by-bite in a sanitary manner, without one's hands directly touching and contaminating the foodstuff 112 to inhibit the spread of disease and pandemics. Thus, allowing one to more efficiently eat foodstuff 112 without soiling one's hands or requiring, the use of any eating accessories, such as utensils.

Figure 3:
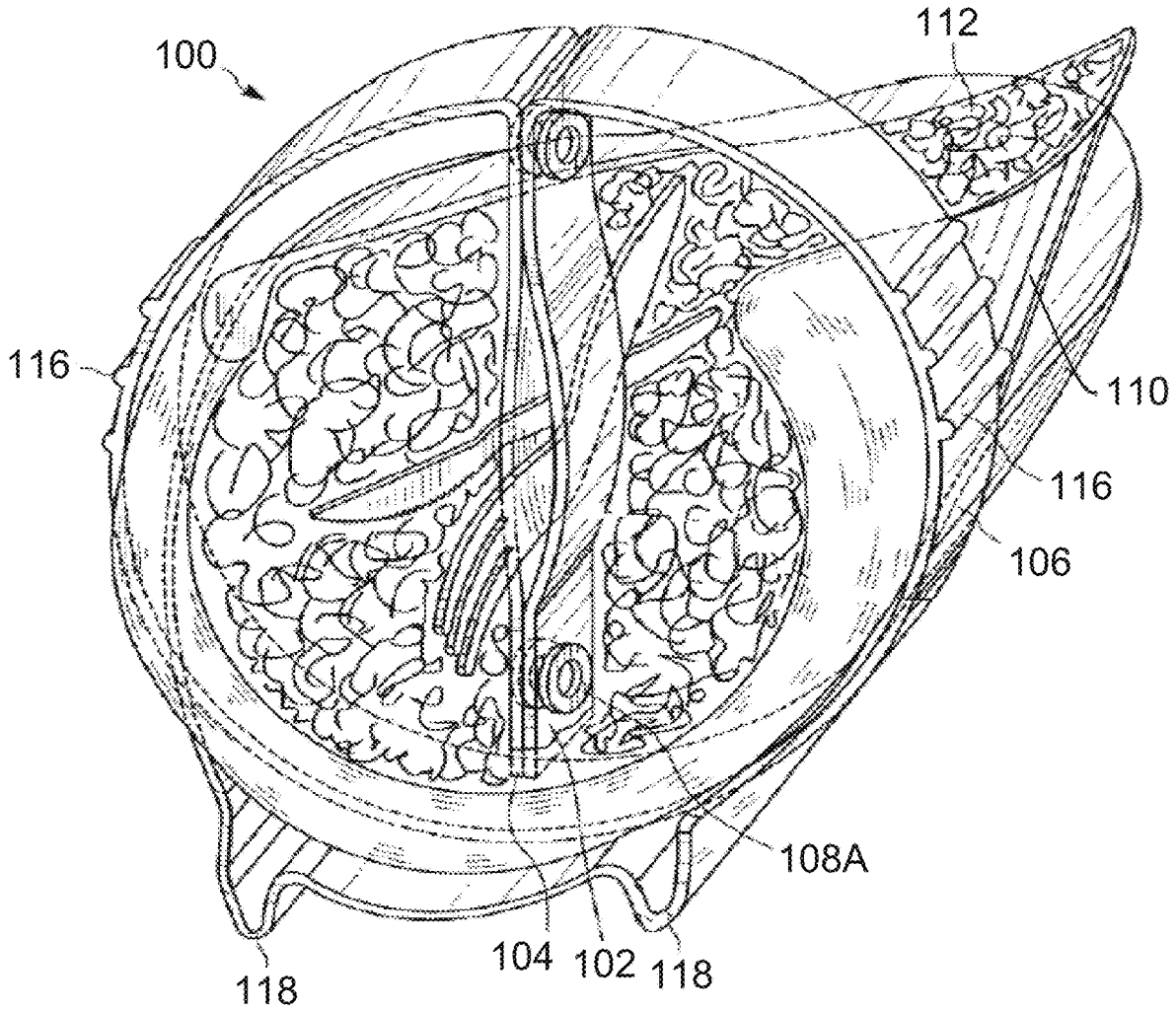
FIG. 3 a perspective view depicting a portable food handling device with foodstuff received therein, in accordance with an alternative embodiment of the disclosure.

With reference to FIG. 3, an alternative embodiment of a portable food handling device 100 is depicted in accordance with an embodiment of the disclosure. Various embodiments of the portable food handling device 100 will be described in detail with reference to the drawings, wherein like reference numerals represent like parts and assemblies throughout the several views. In some embodiments, the portable food handling device 100 can include one or more ribs 116 or any analogous friction enhancing surface, provided on an exterior of the annular body portion 106. In some embodiments, the one or more ribs 116 can serve as thermal insulators to inhibit heat from the foodstuff 112 being transferred to the user's hand. One or more feet 118, or other supporting structure, can be provided on a lower side of the annular body portion 106, thereby enabling a user to rest the food handling device on a supporting structure, such as a table.

Figure 4A:
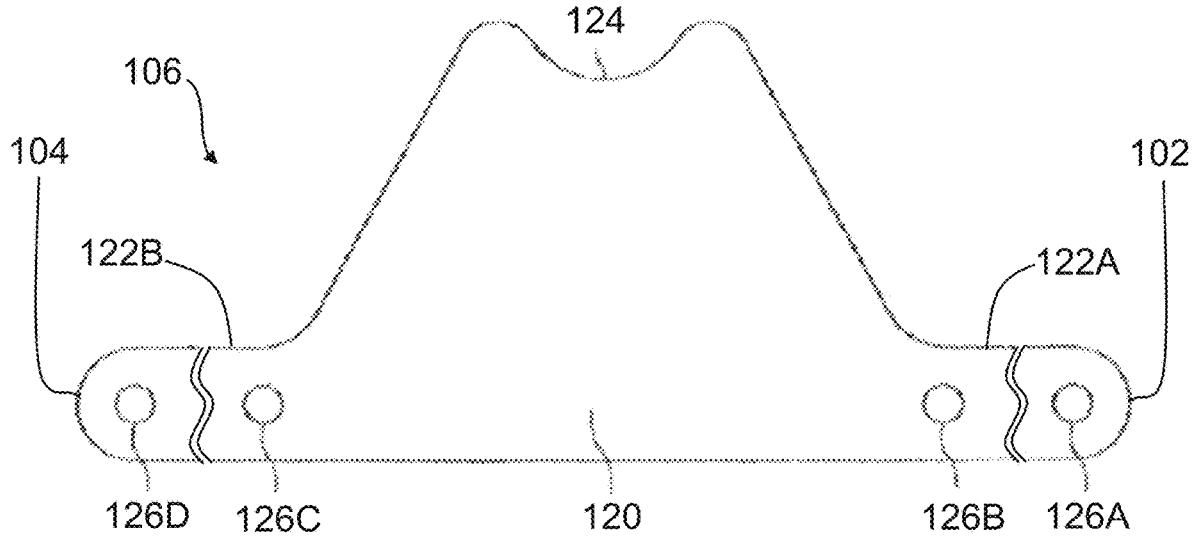
FIG. 4A is a plan view depicting an unassembled portable food handling device, in accordance with an embodiment of the disclosure.
Figure 4B:
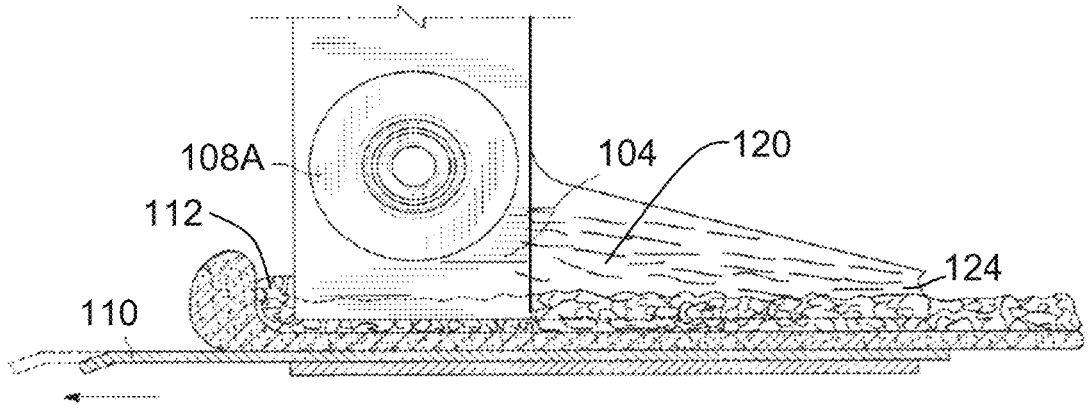
FIG. 4B is a close-up, partial profile view depicting the portable food handling device of FIG. 4A in an assembled configuration, in accordance with an embodiment of the disclosure.

With reference to FIG. 4A, a plan view of an unassembled annular body portion 106 of a portable food handling device 100 is depicted in accordance with an embodiment of the disclosure. In the depicted embodiment, rather than having a constant width, the annular body portion 106 can have a variable width, with an enlarged central section 120 and a pair of narrower collinear arms 122A/B defining one or more apertures 126A-D into which the fasteners can be mounted in a spaced-apart relationship. In some embodiments, the central section 120 can define a concave edge 124. When folded into an annular shape, as partially shown in FIG. 4B, the enlarged central section 120 can provide additional support for the supporting surface 110 and/or the foodstuff 112 itself. The concave edge 124 can inhibit the user from inadvertently biting down on the central section 120 while in use.

Figure 5:
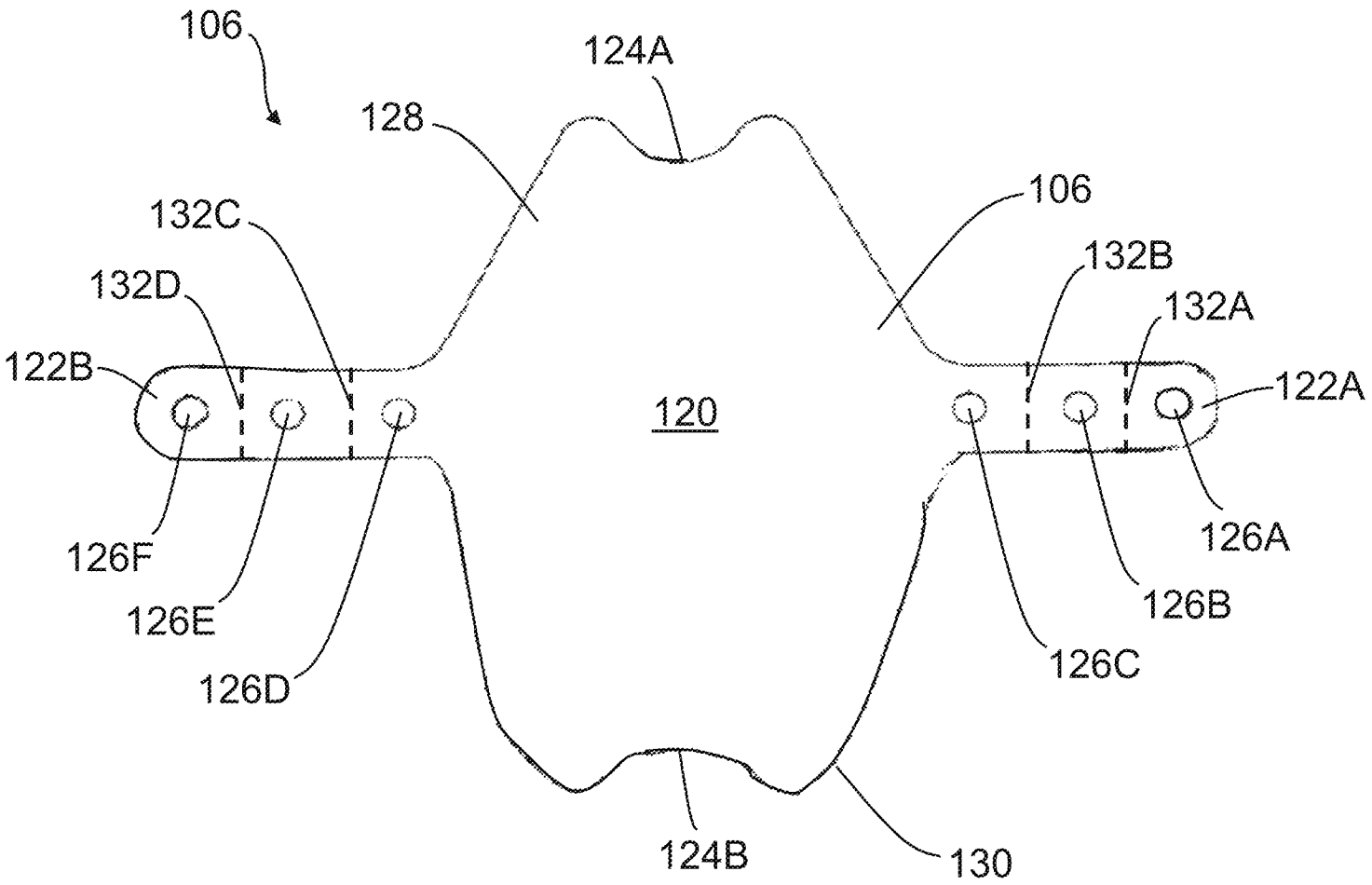
FIG. 5 is a plan view depicting an unassembled portable food handling device, in accordance with an alternative embodiment of the disclosure.

With reference to FIG. 5, a plan view of an unassembled annular body portion 106 of a portable food handling device 100 is depicted in accordance with an embodiment of the disclosure. In the depicted embodiment, the annular body portion 106 can include an enlarged central section 120, including both a forward facing projection 128 and a rear facing projection 130, configured to support a wider variety of foodstuffs 114. Like the previous embodiment, the annular body portion 106 can include one or more concave edges 124A/B configured to inhibit the user from inadvertently biting down either of the forward facing projection 128 or rear facing projection 130. Accordingly, in some embodiments, foodstuffs positioned within the portable food handling device 100 can be moved and consumed in either direction, for example by rotating the portable food handling device 100 by approximately 180°.

Figure 9A:
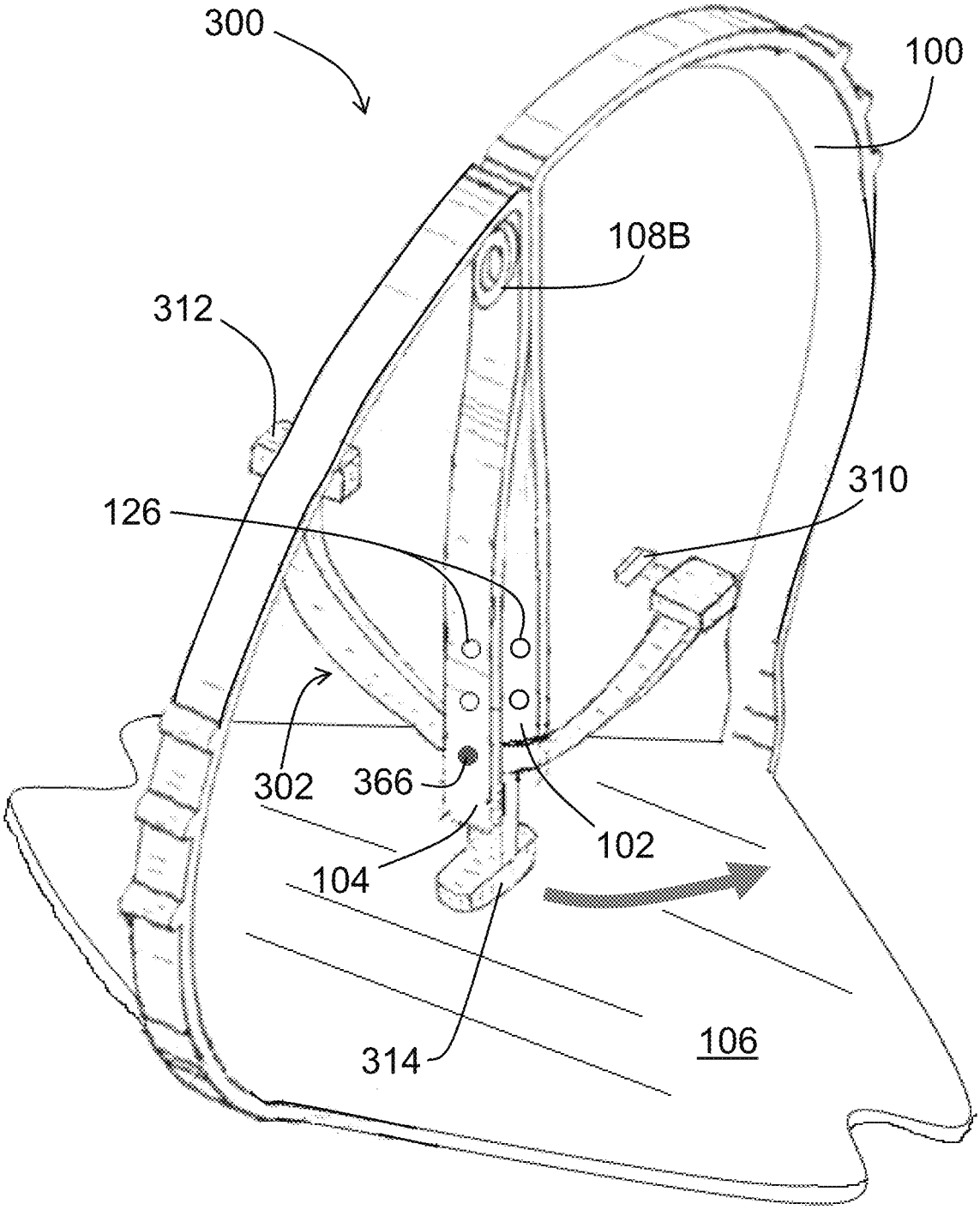
FIG. 9A is a perspective view depicting a portable food handling assembly, in accordance with an embodiment of the disclosure.
Figure 9B:
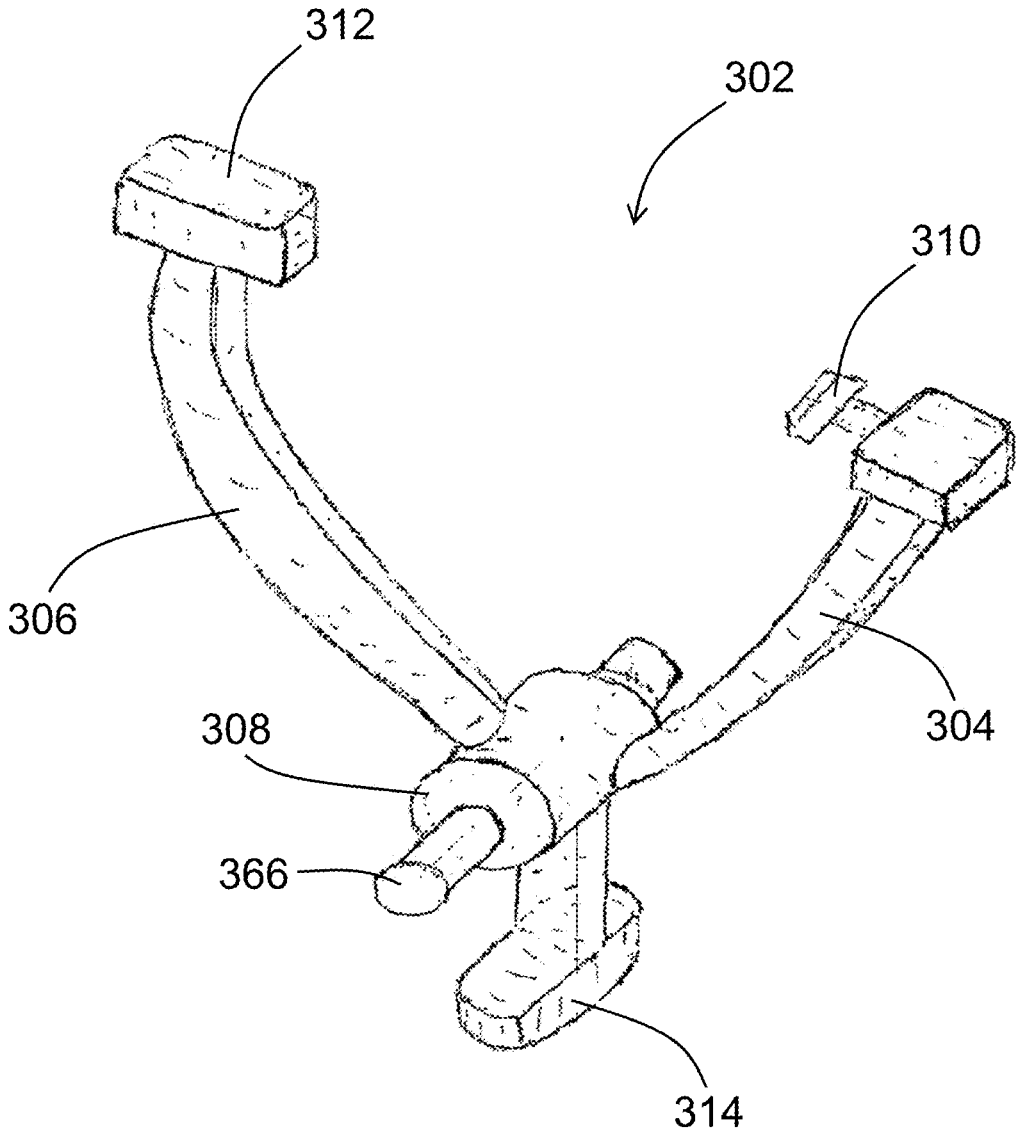
FIG. 9B is a perspective view depicting the feeder of FIG. 9A.

In some embodiments, the annular body portion 106 can include a pair of narrower collinear arms 122A/B defining one or more apertures 126A-F into which a horizontal axle of a feeder, such as the horizontal axle 366 depicted in FIG. 9B, can be inserted and secured, as shown in FIG. 9A. In some embodiments, a greater number of apertures 126 can be formed into the arms 122A/B, such that there is a larger number of apertures 126 than required to secure a feeder. The inclusion of a greater number of apertures 126 offers flexibility in the construction of a variety of different sizes of portable food handling assemblies, such as that shown in FIG. 9A. In some embodiments, one or more perforations 132A-D can be defined in the arms 122A/B, thereby enabling a user to easily remove excess portions of the arms 122A/B, depending upon the size (e.g., diameter of the assembled annular body portion 106) of the constructed portable food handling device 100.

Figure 6:
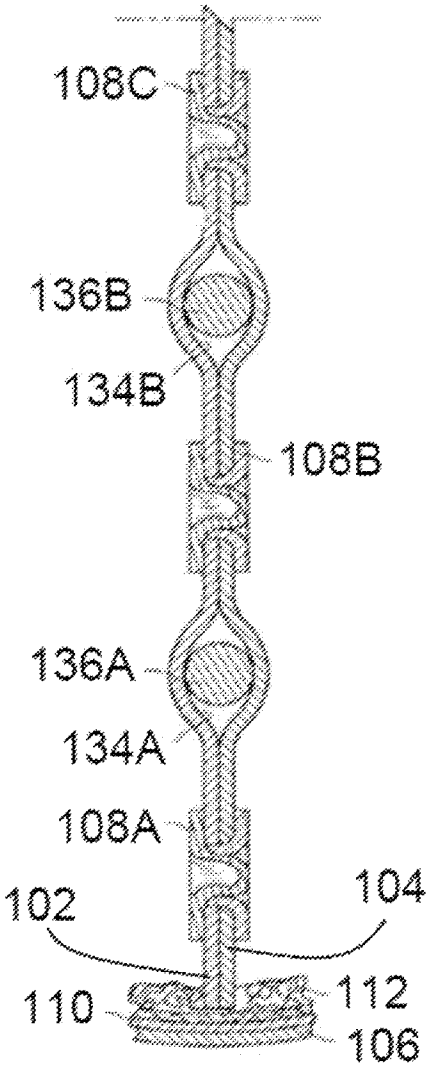
FIG. 6 is a close-up, partial, cross-sectional view depicting a portable food handling device, in accordance with an embodiment of the disclosure.

With reference to FIG. 6, a detailed cross-sectional view of the end regions 102, 104 of a portable food handling device 100 are depicted in accordance with an embodiment of the disclosure. In the depicted embodiment, rather than using two fasteners (such as that depicted in FIGS. 1, 2A & 3), the end regions 102, 104 can be operably coupled together via three fasteners 108A-C. In some embodiments, the end regions 102 can be operably coupled together with enough excess material the form one or more pockets 134A-B configured to hold additional items 136A-B (e.g., foodstuff, utensils, eating accessories, etc.).

Figure 7:
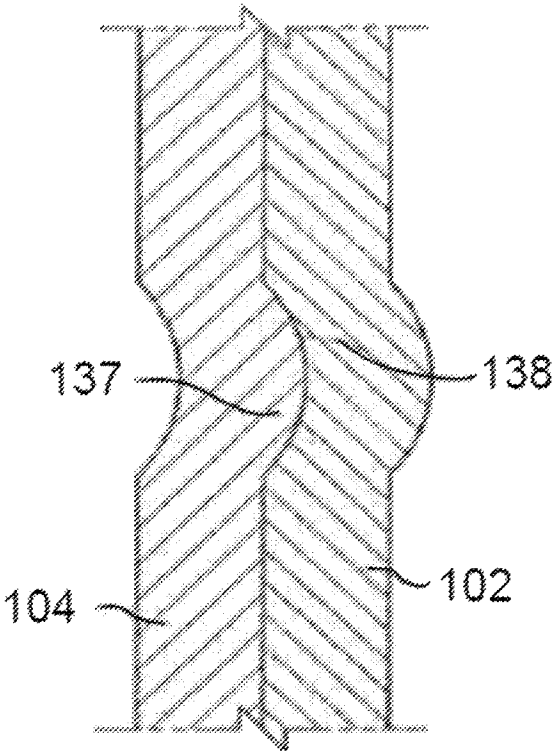
FIG. 7 is a close-up, partial, cross-sectional view depicting a portable food handling device including integrally formed fasteners, in accordance with an embodiment of the disclosure.

With reference to FIG. 7, an alternative fastener 108 is depicted in accordance with an embodiment of the disclosure. In the depicted embodiment, rather than using discrete fasteners (such as that depicted in FIGS. 1, 2A, 3, & 6), the end regions 102, 104 of the annular body portion 106 can be integrally formed with one or more projections 137 and corresponding recesses 138. In such embodiments, each projection 137 can be received in a respective recess 138, preferably with a snap type action, at various positions along the end regions 102, 104, thereby fastening the end regions 102, 104 together at each of these locations. Accordingly, in some embodiments, for ease of construction and lower manufacturing costs, the use of discrete fasteners can be eliminated. In other embodiments, adhesive strips, magnets, or hook and loop fasteners may alternatively be used to secure end regions 102, 104 together. In embodiments, end regions 102, 104 are configured to be repeatedly coupled and uncoupled.

Figure 8A:
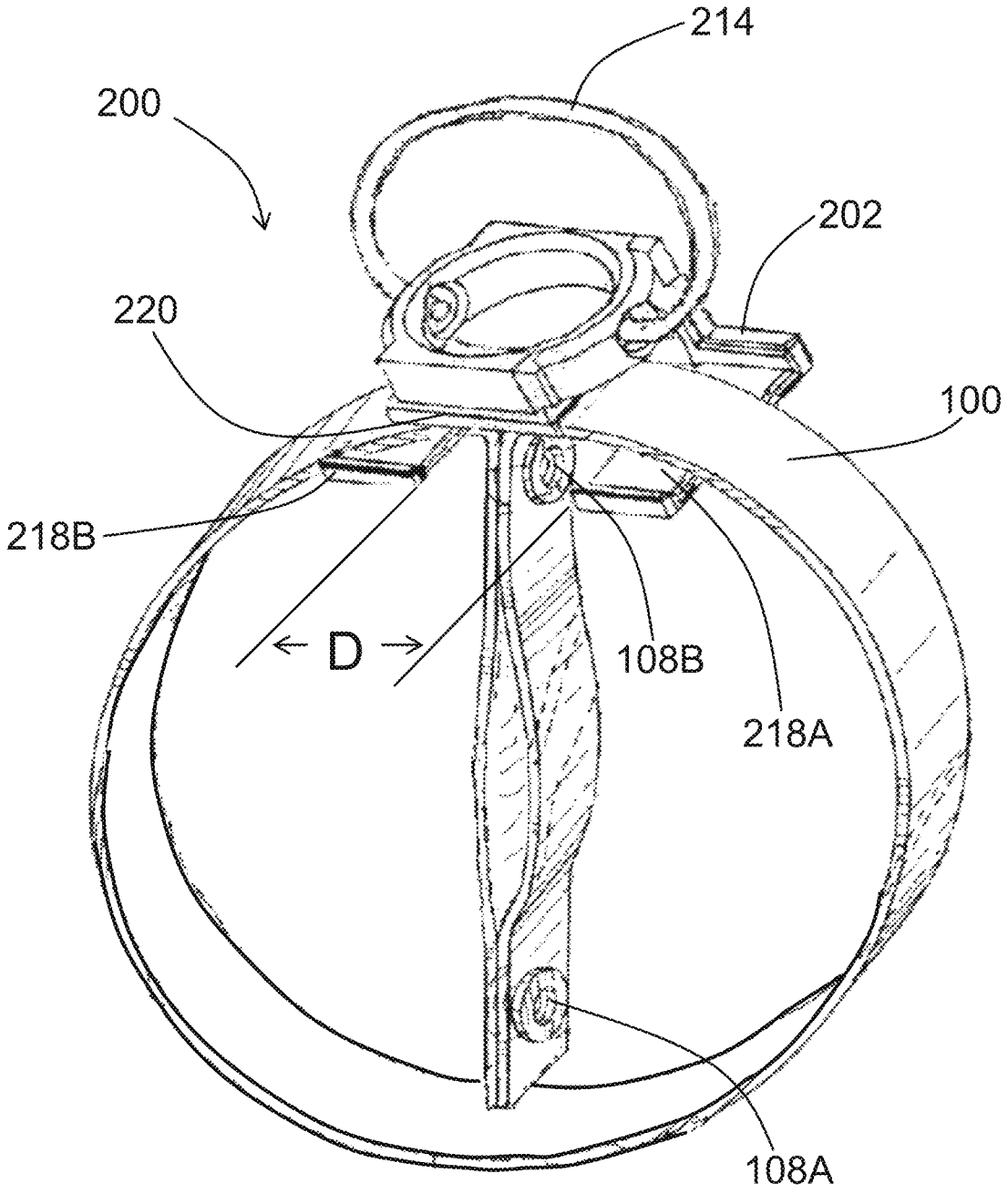
FIG. 8A is a perspective view depicting a portable food handling assembly, in accordance with an embodiment of the disclosure.
Figure 8B:
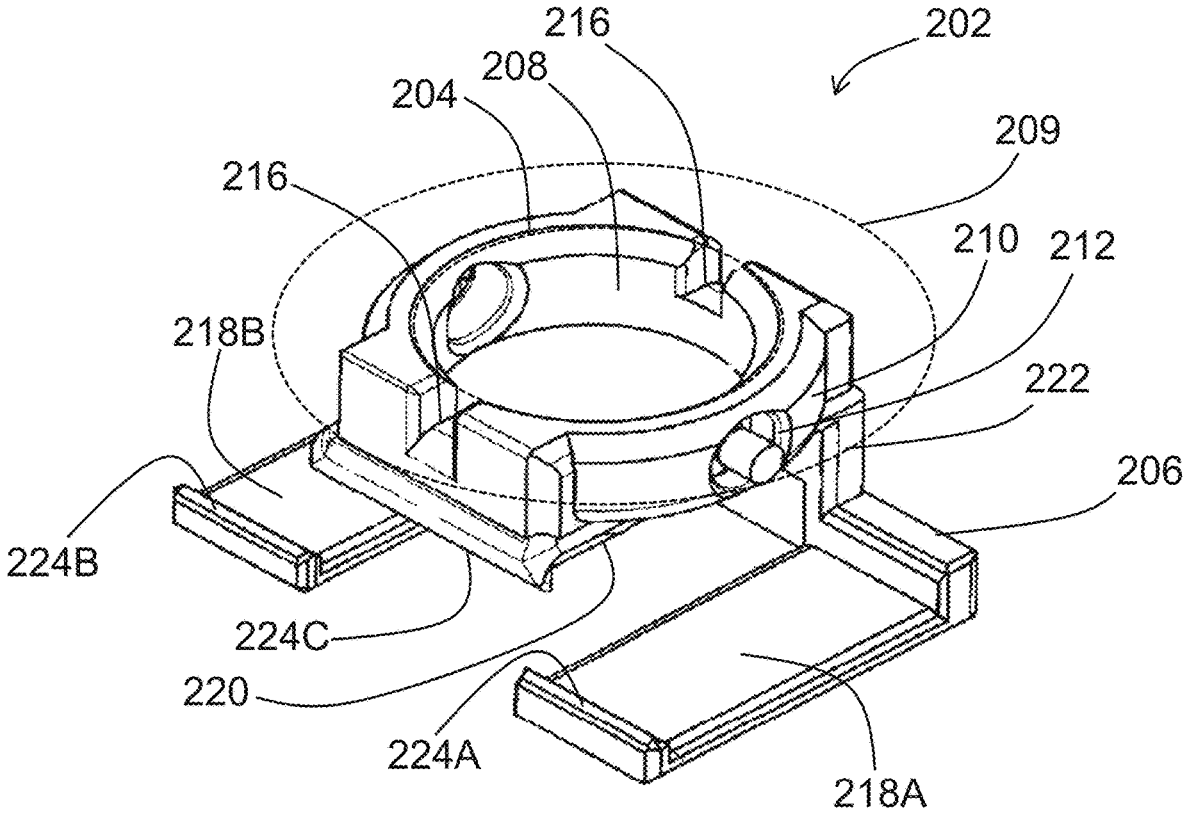
FIG. 8B is a partial, perspective view depicting the bracket-holder of FIG. 8A.

With reference to FIG. 8A, a portable food handling assembly 200 is depicted in accordance with an embodiment of the disclosure. The portable food handling assembly 200 can include a portable food handling device 100 (e.g., any previously described embodiment or combination thereof), and a detachable bracket-holder 202, depicted separately in FIG. 8B. In embodiments, the bracket-holder 202 can include an upper portion 204 and a lower portion 206, which in some embodiments can be constructed of a resilient material. Upper portion 204 can include an internal surface 208 defining a centrally located space for holding beverages, cups, bowls, accessories, etc. In some embodiments, the internal surface 208 defining a centrally located space for holding beverages can include an annual saucer 209 to collect fluid and other spillage from the beverages held therein, shown by broken lines. An external perimeter 210 of the upper portion 204 can include an opening 212 for a ring and/or handle 214 (as depicted in FIG. 8A) and one or more slots 216 for holding accessories (e.g., eating utensils, foodstuffs, electronic devices, etc.).

Lower portion 206 can comprise two or more horizontally spaced apart resilient fingers, including a first resilient finger 218A and a second resilient finger 218B. In some embodiments, the lower portion 206 can have a third resilient finger 220, centrally located between and vertically spaced from the first and second resilient finger 218A/B. In some embodiments, resilient fingers 218A/B, 220 can be operably coupled together via a neck portion 222, thereby creating a space in which a portion of the annular body portion 106 of the portable food handling device 100 can reside and be held in retaining contact (e.g., via an interference fit). In some embodiments, the fingers 218A/B, 220 and/or neck 222 can be constructed of a natural resilient material configured to expand to accommodate insertion of a thickness of the strip of material defining the annular body portion 106, then contract to retain the annular body portion 106 in a gripping fashion.

In some embodiments the bottom fingers 218A/B of the bracket-holder 202 can be press fit under annular body portion 106, while upper finger 220 can be positioned above the annular body portion 106. In some embodiments, horizontally elongated edges of fingers 218A/B, 220 can include vertical projections 224A-C generally pointing toward an inward area to lock the bracket-holder 202 in a fixed position on the annular body portion 106 in a manner that inhibits the bracket-holder 202 from sliding away from the portable food handling device 100. Moreover, in some embodiments, the bracket-holder 202 can be clamped on a top portion of the portable food handling device 100, such that the first and second fingers 218A/B are advantageously positioned on either side of a fastener 108B, and the third finger 220 is positioned above the annular body portion 106 to inhibit a collapse of the portable food handling device 100. For example, in some embodiments, the distance D between the first finger 218A and the second finger 218B can be adjusted to inhibit disengagement of the portable food handling device 100 should the fastener 108A become unintentionally disengaged.

In embodiments, the portable food handling assembly 200 can advantageously be carried with a single hand by a handle 214, which in some embodiments can be detachable and/or foldable when not in use. In some embodiments, the handle 214 can be located on the upper portion 204 external to the central opening and can be configured to balance the portable food handling assembly 200 when loaded with different foodstuffs, beverages, and/or accessory items (e.g., eating utensils, electronic devices, etc.). For example, the handle 214 can be lengthened, adjusted or otherwise spaced, so as to aid a user in balancing the food handling assembly 200.

In some embodiments, the bracket-holder 202 can be used separately from the portable food handling device 100 by clamping the resilient fingers 218A/B, 220 to a surface of tables, desks, chairs, automotive vehicles (e.g., cars, buses, etc.), trains, airplanes, etc. to carry beverages, accessories, and electrical devices. In some embodiments, the bracket-holder 202 can be constructed of a resilient material, such as plastic; although the use of other materials is also contemplated. In yet other embodiments, the portable food handling assembly 200, comprising portable the food handling device 100 and the bracket-holder 202, can be constructed from a single, unitary member, thereby enabling the food handling assembly 200 to take up less space (e.g., store flat) when not in use, as well as presenting ease in assembly/disassembly before and after use.

Figure 21:
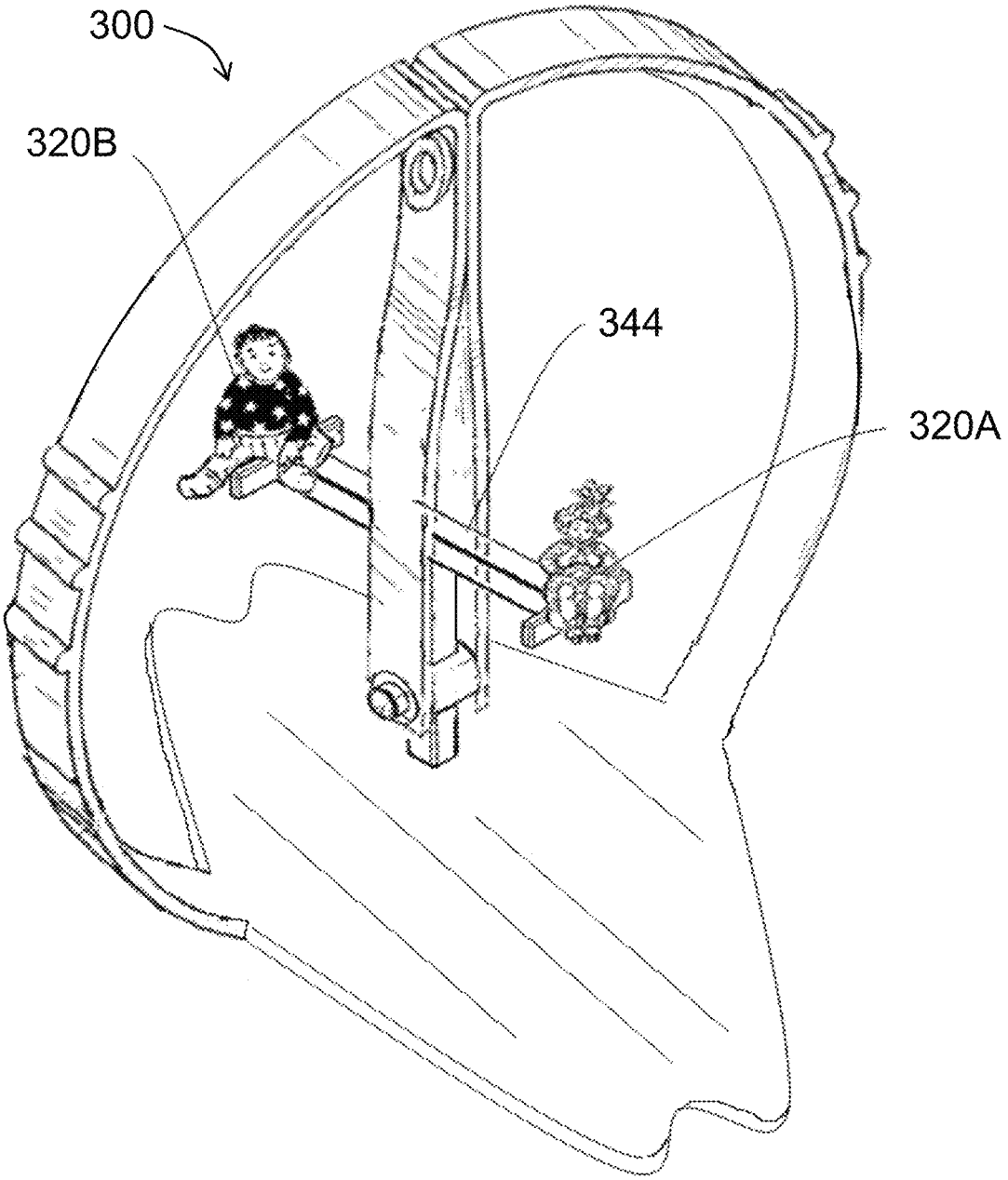
FIG. 21 is a perspective view of a portable food handling assembly including two characters, in accordance with an embodiment of the disclosure.

Referring to FIG. 9A, an alternative portable food handling assembly 300 is depicted in accordance with an embodiment of the disclosure. The portable food handling assembly 300 can include a portable food handling device 100 (e.g., any previously described embodiment or combination thereof), and a feeder 302, depicted separately in FIG. 9B. In some embodiments, the feeder 302 can have a generally wishbone or "Y"-shape; although the use of other shapes, including a "T"-shape configuration, as depicted in FIG. 21, is also contemplated.

In some embodiments, the feeder 302 can include a pair of vertically spaced apart wings 304, 306 operably coupled to a spacer 308 and a horizontal axle 366. The horizontal axle 366 is configured to be inserted into apertures 126 of the annular body portion 106. As depicted in FIG. 9A, the spacer 308 can be positioned between the end regions 102, 104 of a portable food handling device 100 (e.g., in place of fastener 108A), such that the feeder 302 can be configured to pivot in a rocking motion relative to the portable food handling device 100.

In some embodiments, an end portion of the first wing 304 can define a stopper 310, while an end portion of the second wing 306 can define a handle 312. A pointer or scoop 314 can extend generally downwardly from the spacer 308 (e.g., generally opposite the first and second wings 304, 306). A lower portion of the scoop 314 can be engaged with a foodstuff contained within the portable food handling assembly 300. In embodiments, a bottom portion of scoop 314 has a curved surface to accommodate a variety of soft and solid foodstuff located on 106. A feeding motion can be affected by pressing the handle 312, which causes the feeder 302 to rotate relative to the portable food handling device 100, thereby linearly advancing the foodstuff in a bite-by-bite manner into the user's mouth. The foodstuff is thus incrementally exposed so that it can be directly eaten in a sanitary, bite-by-bite manner without using eating accessories, such as plates and/or utensils, as well as without one's hands directly touching and contaminating the foodstuff to prevent the spread of disease and pandemics.

Figure 10:
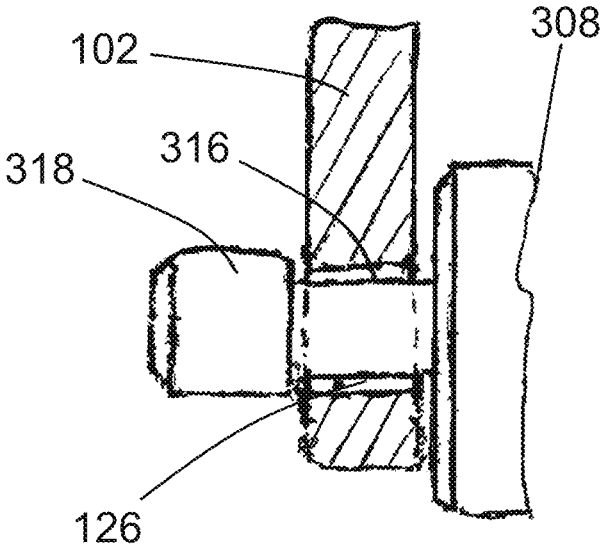
FIG. 10 is a close-up, partial, cross-sectional view depicting a feeder engaged with a food handling device, in accordance with an embodiment of the disclosure.

With reference to FIG. 10, in some embodiments, the feeder 302 can be snapped fit with one or more apertures 126 of the end regions 102/104 of the portable food handling device 100. For example, in one embodiment, the spacer 308 of the feeder 302 can include an axle portion 316 having a first diameter, and a hub portion 318 including a second diameter, wherein the second diameter is larger than the first diameter, such that the axle portion 316 and hub portion 318 can be pushed through the one or more apertures 126, thereby locking the feeder 302 within the aperture 126, while enabling the feeder 302 pivot relative to the portable food handling device 100.

With continued reference to FIG. 9A, the rate of feeding enabled by the feeder 302 (e.g., the pitch of the bite-by-bite motion) depends on how far the stopper 310 is moved until it contacts the end regions 102, 104 of a portable food handling device 100, thereby inhibiting further pivoting of the feeder 302 relative to the portable food handling device 100.

Figure 11:
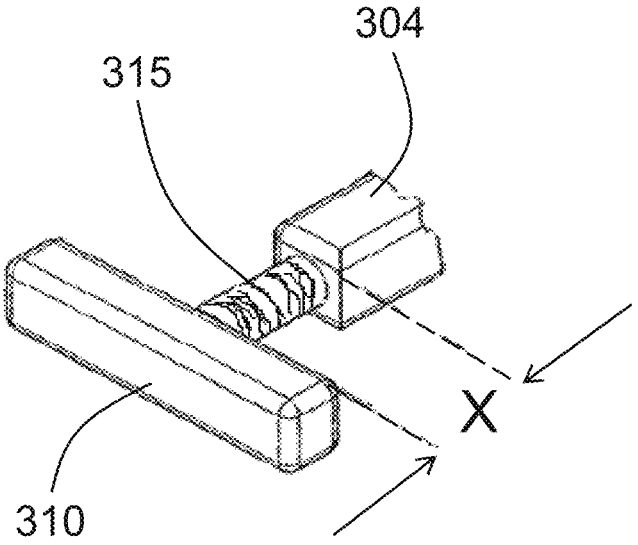
FIG. 11 is a close-up, partial, perspective view depicting an adjustable stopper of a feeder mechanism, in accordance with an embodiment of the disclosure.

Referring to FIG. 11, in some embodiments, the distance X between the stopper 310 and the end of the first wing 304 can be adjusted. In some embodiments, the stopper 310 can be operably coupled to the first wing 304 via a distance adjustment mechanism 315 (e.g., a threaded coupling, slots, pins, or the like). Accordingly, in some embodiments, distance X is variable, thereby enabling a user to tailor the size of a bite received upon each rotation of the feeder 302 relative to the portable food handling device 100.

Figure 12:
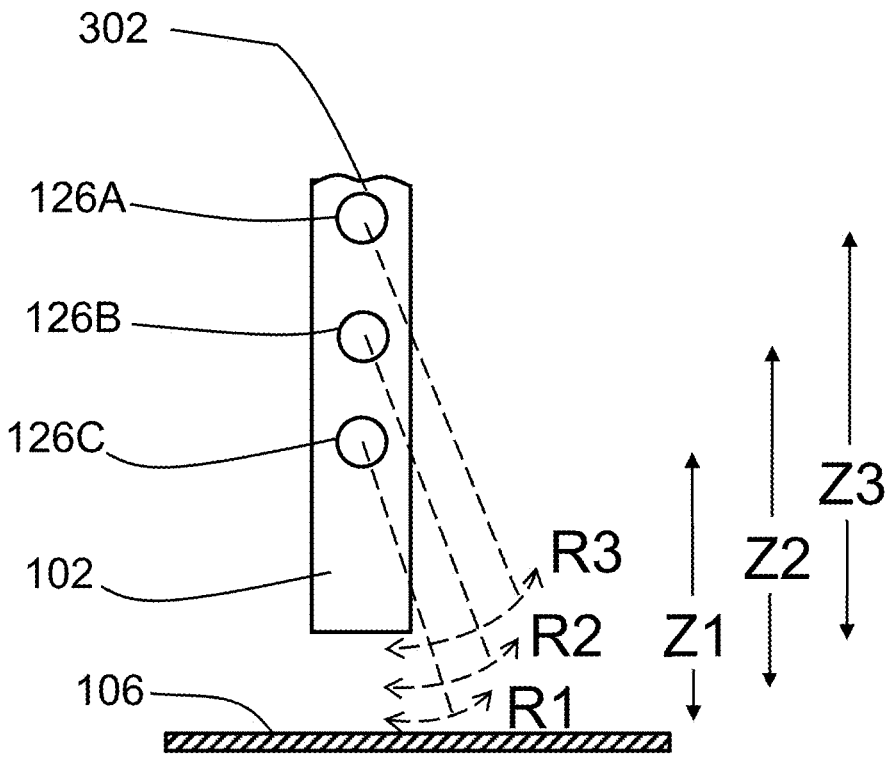
FIG. 12 is a partial, side view of an end region of a food handling device in accordance with an embodiment of the disclosure.

With reference to FIG. 12, in embodiments, the rate of feeding enabled by the feeder 302 can be adjusted by positioning the feeder in one or more sets of apertures 126A-C defined by the portable food handling device 100, thereby properly positioning the feeder 302 at a desired distance from the foodstuff and/or bottom portion of the annular body 106. In some embodiments, the amplitude of oscillation of the feeder 302 (e.g., R1, R2, R3, etc.) can depend on the aperture 126A-C into which a respective axle of the feeder 302 is positioned, to affect a distance (e.g., Z1, Z2, Z3, etc.) between the axle of the feeder 302 and a foodstuff positioned on the portable food handling device 100. The chosen radius determines the linear horizontal motion of food as a longer radius results in less horizontal pitch.

Figure 13:
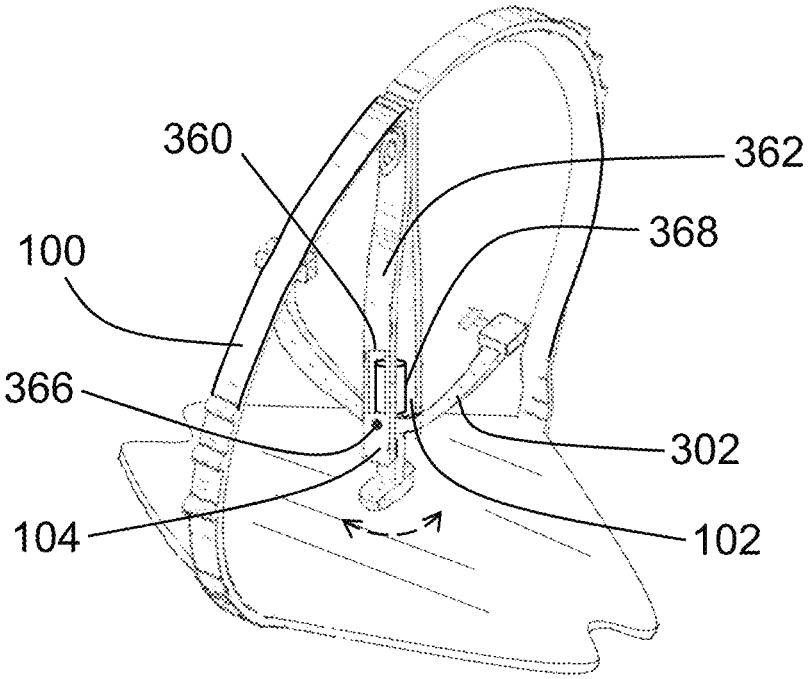
FIG. 13 is a perspective view depicting a portable food handling assembly, in accordance with an embodiment of the disclosure.

Referring to FIG. 13, a spacer 308 of feeder 302 can support an interchangeable display mechanism 368 between the end regions 102, 104 of a portable food handling device 100. The interchangeable display mechanism can be further viewed through a window slot 360 of a strip 362 of portable food handling device 100. In embodiments, the interchangeable display mechanism 368 is configured to receive interchangeable display elements, such as a roll of sequential images or a moveable character.

Figure 14:
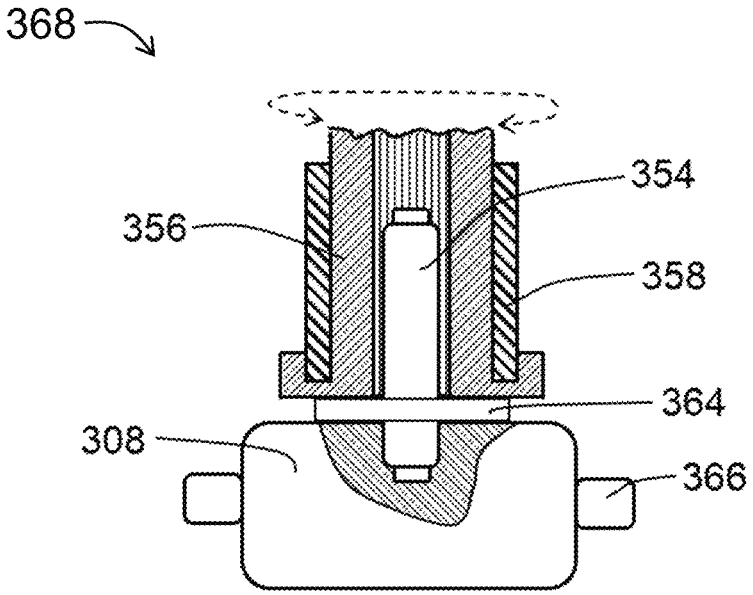
FIG. 14 is a close-up, partial, cross-sectional view depicting an interchangeable display mechanism, in accordance with an embodiment of the disclosure.

Referring to FIG. 14, a close-up, partial, cross-sectional view of the interchangeable display mechanism 368 and spacer 308 is depicted, according to an embodiment. In some embodiments, a vertical axle 354 can protrude from the spacer 308. In embodiments, a collar 364 contacts a freely moving bushing 356 comprising a roll of sequential still images 358. By manually rotating or spinning the bushing, the roll of still images can revolve independently around the vertical axle 354. The collar 364 provides support for the rotation of bushing 356.

Figure 15:
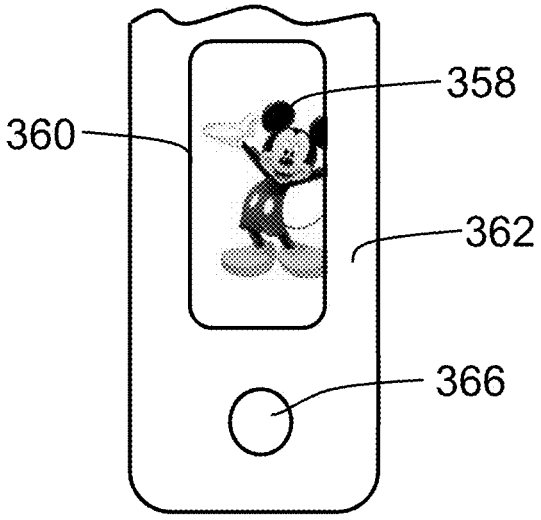
FIG. 15 is a close-up, side view depicting an interchangeable display mechanism, in accordance with an embodiment of the disclosure.

Referring to FIG. 15, a window slot 360 within the strip 362 can act as a shutter. When the bushing 356 revolves around the vertical axle 354, window slot 360 momentarily reveals each of the images of the roll of sequential images 358 in quick enough succession that the viewer interprets the images as a continuous moving image. In embodiments, the strip 362 could include a second window slot on the side opposite the first window slot 360 such that the continuous moving image can be viewed from both sides.

Figure 16:
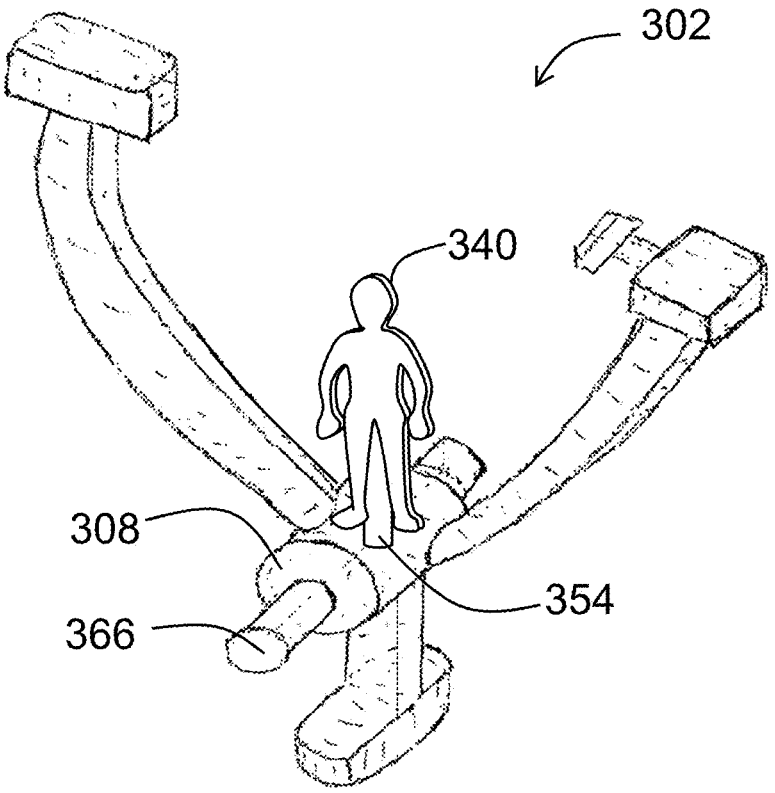
FIG. 16 is a perspective view of an interchangeable display mechanism including a character, in accordance with an embodiment of the disclosure.
Figure 17:
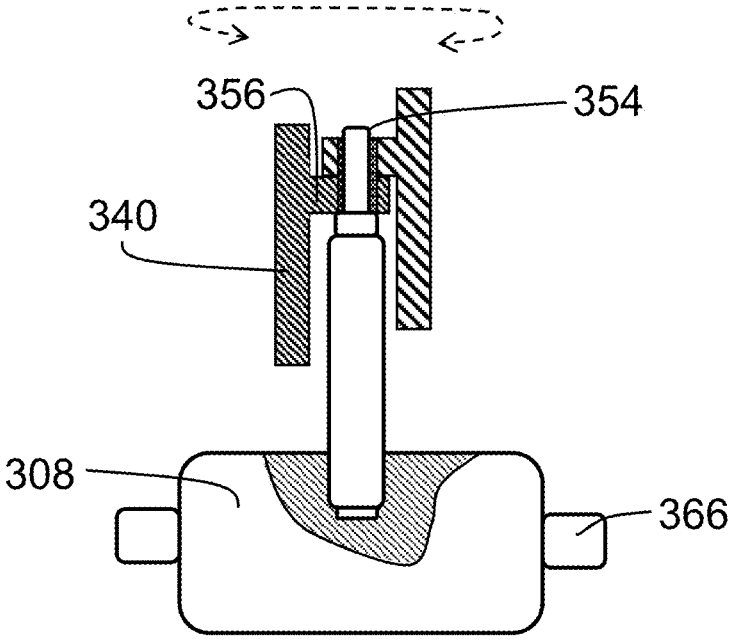
FIG. 17 is a close-up, partial, cross-sectional view depicting an interchangeable display mechanism including the character from FIG. 16.

Referring to FIG. 16, in some embodiments, the vertical axle can support a character 340. In some embodiments, the character 340 can move based on the movement of the feeder 302. In embodiments, the character 340 can rotate with the vertical axle 354, as shown in FIG. 17. In embodiments, the character 340 can comprise a bushing that can be removably coupled to the vertical axle 354 such that the character can rotate. In such embodiments, characters can be interchangeable depending on the user's preference. In embodiments, more than one character can be selectively attached to axle 354. The one or more characters can be freely rotated on the vertical axle 354. In embodiments, multiple characters could be evenly spaced around the axle. Similarly, the feeder 302 and interchangeable display mechanism 368 can be used to display both characters and a roll of sequential still images at different times.

Figure 18:
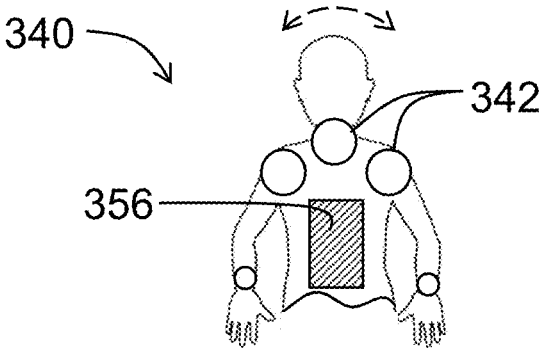
FIG. 18 is a close-up, partial view of a character for an interchangeable display mechanism, in accordance with an embodiment of the disclosure.

Referring to FIG. 18, a character can include hinges 342 or pivots to facilitate movement of different parts of the character 340. In an embodiment, the character 340 can be a marching soldier, an animal, or other characters.

Figure 19:
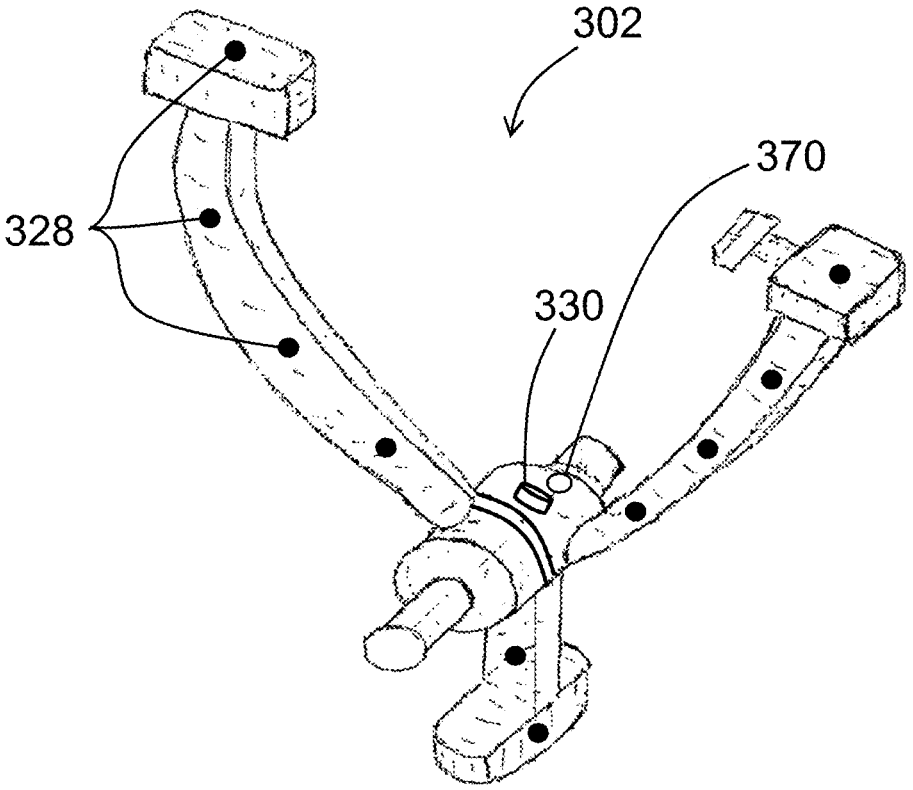
FIG. 19 is a perspective view depicting a feeder mechanism, in accordance with an embodiment of the disclosure.

Referring to FIG. 19, in some embodiments, the feeder 302 can comprise transparent materials, such as a clear plastic, and include internal lights 328. The spacer 308 can include a switch 330. The switch 330 can be used to control the internal lights 328. In embodiments, the switch 330 can be a button or toggle switch. The switch 330 can be used to alternate between lighting modes. Lighting modes can include lighting different areas of the feeder 302, lighting with different colors, or periodically changing the lighting, such as pulsating the lights 328.

In some embodiments, the feeder 302 can include a camera 370 and an output device configured to record and transmit the food consumption experience by wireless connection to an electronic device with a display. In such embodiments, the food consumption experience can be broadcasted or transmitted to electronic devices, such as phones or computers, of other users. For example, parents in real time could remotely check child eating habits. In some embodiments, the food consumption experience can be recorded and stored at the electronic device for later viewing.

The camera 370 and the output device are particularly useful in a pandemic where social distancing is imposed as it allows individuals of all ages to share their food consumption experiences with others. The sharing of these experiences can benefit a user's overall health and self-esteem by providing a safe method communication.

Another useful application of the camera 370 and the output device is to record and analyze health data related to the quality and quantity of food consumed individually. Additionally, such health data can be aggregated for large groups using portable food handling assemblies, such as in schools, day care centers, hospital cafeterias, and athlete training centers.

In embodiments, the internal lights 328 are powered by a battery located within the feeder 302. The battery can be a rechargeable battery stored in the spacer 308. The spacer 308 can be configured to allow for charging of the battery, such as by including a charging port (not shown).

Figure 20:
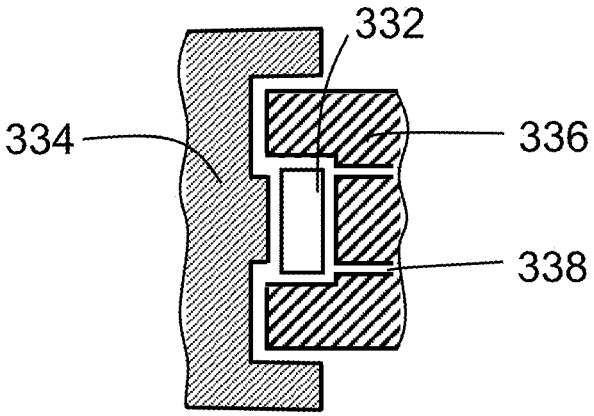
FIG. 20 is a cross-sectional, partial view of a spacer containing a battery, in accordance with an embodiment of the disclosure.

In some embodiments, the battery can be stored within the spacer 308. Spacer 308 can comprise an interconnected thread to protect the battery, as depicted in FIG. 20. In reference to FIG. 20, a battery 332 can be located between a first threaded portion 334 and a second threaded portion 336 of the spacer 308. In embodiments, the second threaded portion 336 comprises wire channels 338. Such an arrangement can create a seal to protect the battery 332. In embodiments, the spacer 308 could comprise other connection means, such as snaps.

In some embodiments, LED strips can be used for lights 328. LED strips can be attached to the portable food handling assembly 300 via adhesives or other means known in the art. In embodiments, LED strips can be water resistant.

Referring to FIG. 21, in some embodiments, portions of the feeder 302 can include characters 320 A/B to enhance the feeding and/or eating experience. For example, in some embodiments, the portable food handling assembly 300 can be used as a toy for promotional and/or marketing purposes (e.g., at fast food restaurants, chain restaurants or other eating establishments). Accordingly, characters 320A/B can include references from current or upcoming movies, familiar childhood characters, superheroes, and other references from popular culture. In some embodiments, a 3-D image of a person or object can be electronically captured, such that the one or more characters 320 can be printed in the person or object's likeness. For example, some restaurants may include a 3-D scanner or other type of optical image capturing device, along with a 3-D printer or other device configured to print the one or more characters 320 on-site, which may then be coupled to the feeder 302 prior to use. For example, in some embodiments, personalize human or animal characters with a personalized face, logo, etc. can be added to the feeder 302. In some embodiments, two or more characters 320 A/B can be configured to sit on the feeder 302 to rock back and forth in a teeter-totter motion. In other embodiments, the characters 302 can be configured to mimic an action (e.g., running, jumping, flying, etc.) as the feeder 302 moves relative to the portable food handling device 100.

Figure 22A:
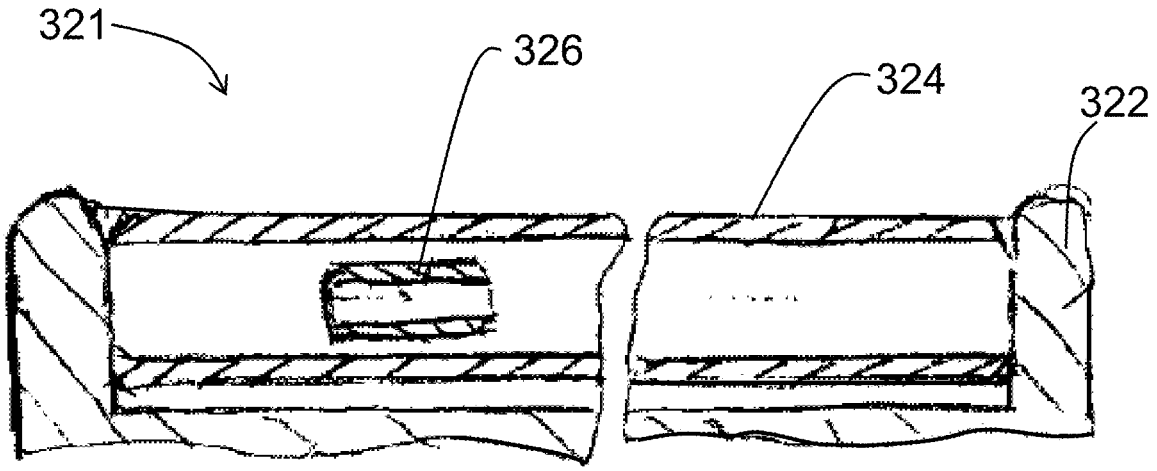
FIG. 22A is a close-up, partial, cross-sectional view depicting a movable capsule assembly, in accordance with an embodiment of the disclosure.
Figure 22B:
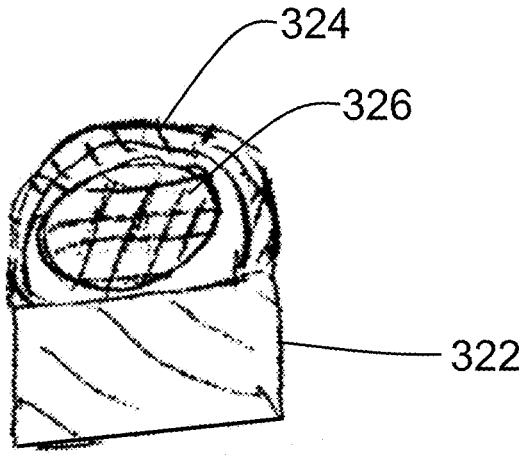
FIG. 22B is a close-up, partial, cross-sectional, side view depicting the movable capsule assembly of FIG. 22A.

Referring to FIGS. 22A-B, in some embodiments, one or more movable capsule assemblies 321 can be affixed to a portion of the feeder 302 (e.g., mounted on a top surface of tube 344) or can be substituted for the tube 344. In embodiments, the one or more movable capsule assemblies 321 can be configured in different shapes and designs. In some embodiments, the one or more movable capsule assemblies 321 can include a bracket 322 configured to house a tube 324, which in some embodiments can be constructed of a transparent or translucent material. A shuttle 326 can be positioned within the tube 324, such that the shuttle 326 can slide relative to the tube 324 as the feeder 302 pivots relative to the food handling device 100. In some embodiments, one or more printed materials can be imprinted or co-positioned on the shuttle 326. For example, the shuttle 326 can be configured as an exchangeable capsule cartridge, such that numbers, letters, words, phrases etc. can be written on paper and inserted into an exchangeable capsule cartridge. For example, words like "broccoli," "celery," or other words can be positioned on the shuttle 326 as a like type of foodstuff is manipulated by the feeder 302 into the mouth of a user. In this manner, by constantly exposing a user (e.g., a child) to repetition of the word or phrase, the user may associate the word or phrase with the foodstuff being consumed. In other embodiments, the shuttle 326 can be replaced with other items (e.g., dice, balls, logos, etc.) as a way of marketing or otherwise advertising goods or services in conjunction with the foodstuff. In some embodiments, the tube 324 can be sealed (like a miniature aquarium) and filled with liquid. In such embodiments, colorful toys, such as fish and sharks, can be placed in tube 324 to create the impression that the colorful toys are swimming.

Figure 23:
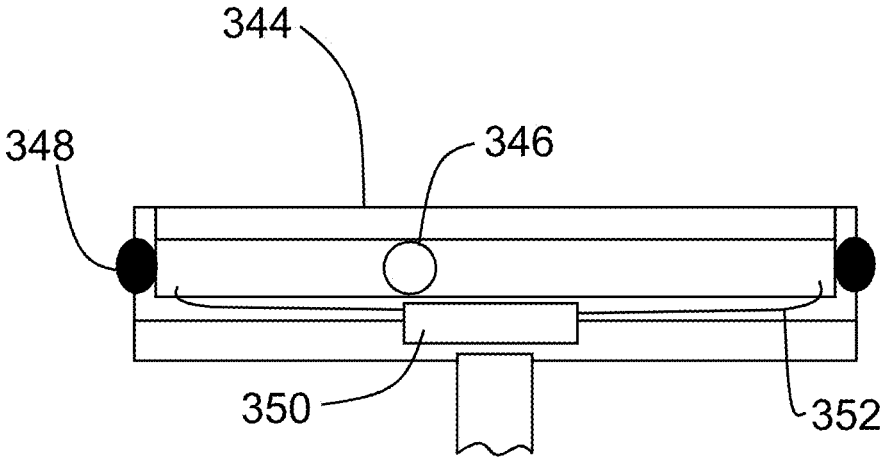
FIG. 23 is a close-up, partial, cross-sectional view depicting a lighting assembly, in accordance with an embodiment of the disclosure.

Referring again to FIG. 21, in some embodiments, a tube 344 between the characters 320A/B can comprise transparent material. Referring to FIG. 23, a ball 346 or shuttle can be positioned within tube 344, such that ball 346 can slide relative to the tube 344 as the feeder 302 pivots relative to the food handling device 100. In some embodiments, lights 348 can be positioned at either end of the tube 344. The ball 346 can comprise conductive material such that when it contacts either end of the tube 344 the ball 346 completes a circuit with a battery 350 by contacting a set of wires 352. The completed circuit can result in the lighting of lights 348. In embodiments, the ball 346 can rest in an alcove located in the middle of the tube (not shown). In some embodiments, a plurality of lights can be used.

In some embodiments, a movable capsule assembly can be affixed to or within the tube 344. Similarly, a tube mechanism for completing a circuit as displayed in FIG. 23 can be applied to any portion of the feeder 302, such as the stopper 310, the handle 312, or the scoop 314.

Figure 24:
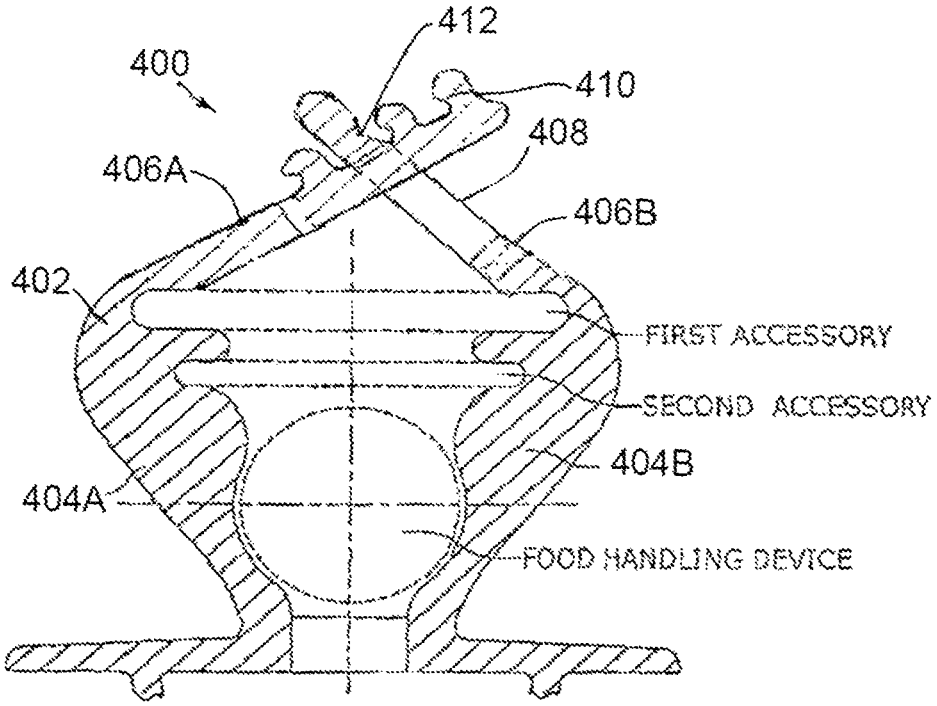
FIG. 24 is a cross-section view depicting an assembly configured to selectively retain a food handling device, in accordance with an embodiment of the disclosure.
Figure 25:
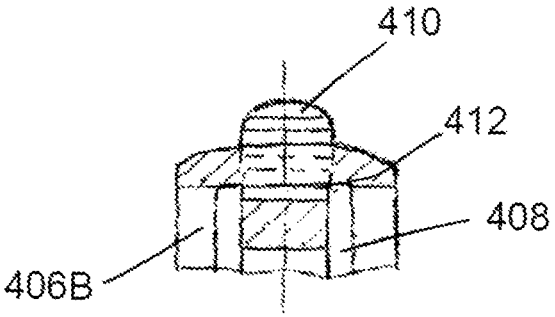
FIG. 25 is a close-up, cross-sectional view depicting a teeth engagement mechanism of the assembly depicted in FIG. 24.

FIGS. 24 and 25 depict an embodiment of the assembly 400 configured to selectively retain the food handling device 100. In some embodiments, the assembly 400 can include an upper portion 402 having a pair of opposed resilient lips 404A/B. The upper portion 402 can be angularly elongated to create resilient fingers 406A/B, which can be interlocked together to create a secure installation of the food handling device 100 and accessories. In some embodiments, a portion of finger 406B can have a centrally located slot 408, in which a portion of resilient finger 406A can be inserted. Resilient finger 406A can have several teeth 410. Upper portion of slot 408 can have a pit 412. In an interlocking position, the resilient fingers 406A/B can be curved toward one another, while one of the resilient fingers (e.g., 406A) can be inserted into the slot 408 and held in the interlocking position by a natural resilient, spring action. A desired locking tension of the engagement can be achieved by changing the size and/or shape of the teeth 410 and, by engaging with one of the several teeth 410 located horizontally at the end portion on an outer surface of the finger 406B (see FIG. 25). When not in use, the resilient fingers 406A/B can be disengaged, thereby enabling the food handling device and accessories to be freely released.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A portable food handling device, comprising:

a flexible strip having a body portion and a first and second end region, the body portion bent into a closed loop configuration to define an interior space configured to receive foodstuffs therein, the first and second end regions removably coupled and extending at least partially diametrically across the interior space defined by the body portion to contact the foodstuffs received within the interior space; and a detachable bracket holder having and at least two fingers configured to be positioned on opposing sides of the body portion of the flexible strip such that the detachable bracket holder is configured to selectively clip onto the body portion of the portable food handling device.

2. The portable food handling device of claim 1, wherein the body portion further comprises a projection configured to support foodstuffs received within the interior space.

3. The portable food handling device of claim 1, wherein the first and second end regions are removably coupled by at least one of adhesive strips, magnets, and hook and loop fasteners.

4. The portable food handling device of claim 1, wherein the detachable bracket holder further comprises a sidewall defining a space for receiving a beverage container.

5. The portable food handling device of claim 1, wherein the detachable bracket holder further comprises a sidewall defining one or more slots configured to receive at least one of eating utensils, foodstuffs or electronic devices.

6. The portable food handling device of claim 1, wherein the detachable bracket holder further comprises a handle.

7. The portable food handling device of claim 1, wherein the detachable bracket holder is clamped to a top portion of the closed loop configuration flexible strip with the at least two fingers positioned on opposite sides of the first and second end regions, wherein a distance between the at least two fingers is adjustable to inhibit disengagement from the flexible strip.

8. The portable food handling device of claim 1, wherein each of the at least two fingers of the detachable bracket holder define a vertical projection configured to inhibit the bracket-holder from detaching from the flexible strip.

9. The portable food handling device of claim 1, wherein the detachable bracket holder further defines an annual saucer configured to collect fluid and other spillage from a beverage held by the detachable bracket holder.

10. A portable food handling device comprising:

a flexible strip having a body portion and a first and second end region, the body portion bent into a closed loop configuration to define an interior space configured to receive foodstuffs therein, the first and second end regions removably coupled and extending at least partially diametrically across the interior space defined by the body portion to contact the foodstuffs received within the interior space, wherein the first and second regions define one or more pairs of apertures;

a feeder mechanism having a first arm, a second arm, and a scoop coupled to and protruding from a spacer;

a horizontal axle extending through the spacer and arranged perpendicular to the first arm, the second arm, and the scoop, the horizontal axle configured to be inserted into one of the one or more pair of apertures such that the spacer is primarily located between the first and second end regions of the flexible strip; and wherein the feeder is configured to pivot in a rocking motion relative to the portable food handling device to linearly advance the foodstuffs received within the interior space through the flexible strip in a bite-by-bite manner via the scoop.

11. The portable food handling device of claim 10, wherein the second arm of the feeder mechanism further comprises an adjustable stopper configured to enable adjustment of the linear advancement of the foodstuffs through the flexible strip.

12. The portable food handling device of claim 10, wherein the feeder mechanism further comprises one or more character figurines coupled to the first arm or the second arm.

13. The portable food handling device of claim 10, wherein the feeder mechanism further comprises:

a vertical axle protruding from the spacer on the side opposite the scoop; and a collar defining a central aperture, the collar positioned on the spacer such that the vertical axle extends through the central aperture.

14. The portable food handling device of claim 13, wherein at least one of the first and second end regions of the flexible strip further define a viewing aperture adjacent to the vertical axle.

15. The portable food handling device of claim 14, further comprising:

a bushing with an interior surface and an exterior surface, the exterior surface having a roll of sequential still images, wherein the interior surface of the bushing is configured to removably accept the vertical axle such that the bushing is configured to rest on the collar and spin independently from the vertical axle.

16. The portable food handling device of claim 13, further comprising:

a bushing with an interior surface and an exterior surface, the exterior surface having one or more character figurines, wherein the interior surface of the bushing is configured to removably accept the vertical axle such that the bushing is configured to rest on the collar and spin independently from the vertical axle.

17. The portable food handling device of claim 16, wherein the character figurine comprises at least one of hinges or joints.

18. The portable food handling device of claim 10, wherein the feeder mechanism is partially comprised of transparent material and further comprises:

a light source positioned within the feeder mechanism, and a power supply positioned within in the spacer, the power supply configured to power the light source.

19. The portable food handling device of claim 18, further comprising:

a camera coupled to the spacer, the camera configured to record camera data;

an output device positioned within the spacer, the output device configured to wirelessly transmit the camera data to an electronic device, wherein the power supply is further configured to power to the camera and the output device.

20. The portable food handling device of claim 10, wherein the feeder mechanism further comprises:

a tube positioned within the spacer; and a shuttle positioned within the tube such that the shuttle can slide relative to the tube as the feeder pivots relative to the food handling device.

21. The portable food handling device of claim 20, wherein the tube contains a liquid.

22. The portable food handling device of claim 20, wherein the tube further comprises a power supply and at least one light source, wherein the shuttle comprises conductive material and is configured to connect a circuit between the power supply and the at least one light source upon reaching an end of the tube.

23. The portable food handling device of claim 10, further comprising:

a storage device having a storage body portion, a first elongated finger and a second elongated finger, the first elongated finger comprising one or more teeth and the second elongated finger comprising one or more slots configured to selectively receive the one or more teeth when in a locked position; and wherein the storage body portion defines an interior space configured to store the flexible strip when in the locked position and to release the flexible strip when not in the locked position.

24. The portable food handling device of claim 23, wherein the storage device is further configured to store one or more food handling accessories when in a locked position and release the one or more food handling accessories when not in the locked position.

25. The portable food handling device of claim 10, wherein the scoop defines a curved area to affect a sweeping food effect.

* * * * *